US011304872B2

(12) United States Patent
Izumitani

(10) Patent No.: US 11,304,872 B2
(45) Date of Patent: Apr. 19, 2022

(54) BATHTUB

(71) Applicant: TOTO LTD., Kitakyushu (JP)

(72) Inventor: Yasuhiko Izumitani, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 77 days.

(21) Appl. No.: 16/489,648

(22) PCT Filed: Dec. 27, 2017

(86) PCT No.: PCT/JP2017/046949
§ 371 (c)(1),
(2) Date: Aug. 28, 2019

(87) PCT Pub. No.: WO2018/159090
PCT Pub. Date: Sep. 7, 2018

(65) Prior Publication Data

US 2020/0009012 A1 Jan. 9, 2020

(30) Foreign Application Priority Data

Feb. 28, 2017 (JP) ..... JP2017-036911
Nov. 15, 2017 (JP) ..... JP2017-219922

(51) Int. Cl.
*A61H 33/00* (2006.01)

(52) U.S. Cl.
CPC ..... *A61H 33/0091* (2013.01); *A61H 33/0095* (2013.01); *A61H 33/6005* (2013.01); *A61H 33/6068* (2013.01); *A61H 2205/02* (2013.01); *A61H 2205/062* (2013.01); *A61H 2205/081* (2013.01)

(58) Field of Classification Search
CPC ..... A47K 3/12; A47K 3/122; A47K 3/125; A47K 3/022; A47K 3/04; A61H 33/0087; A61H 33/0091; A61H 33/6063; A61H 33/6005; A61G 7/1003
See application file for complete search history.

(56) References Cited

U.S. PATENT DOCUMENTS 2,566,495 A * 9/1951 Miyakawa ..... A47K 3/02 4/590
4,839,930 A * 6/1989 Watkins ..... A61H 23/04 4/541.1
5,309,581 A * 5/1994 Lockwood ..... E04H 4/14 239/590.3
D365,144 S * 12/1995 Gruber ..... D23/277
(Continued)

FOREIGN PATENT DOCUMENTS

DE 4422604 * 2/1996 ..... A47K 3/12
JP H02-261455 A 10/1990
(Continued)

*Primary Examiner* — David P Angwin
*Assistant Examiner* — Nicholas A Ros
(74) *Attorney, Agent, or Firm* — Pearne & Gordon LLP

(57) ABSTRACT

There is provided a bathtub, including: a bottom surface part; a side surface part surrounding the bottom surface part, extending upward from the bottom surface part, and including a backrest part; a pillow part provided to be movable vertically over a prescribed range along the backrest part; and a water discharger mounted to the pillow part, the water discharger being provided to be movable vertically along the backrest part with the pillow part.

7 Claims, 24 Drawing Sheets

(56) References Cited

U.S. PATENT DOCUMENTS

| | | | | | |
|---|---|---|---|---|---|
| 5,617,591 | A * | 4/1997 | Bloemer | A61H 23/04 | 239/587.1 |
| 5,682,625 | A * | 11/1997 | Leaverton | A47K 3/125 | 4/541.1 |
| 7,200,879 | B2 * | 4/2007 | Li | E04H 4/14 | 4/507 |
| 7,310,835 | B2 * | 12/2007 | Walker | A47K 3/125 | 4/541.1 |
| 9,662,268 | B2 * | 5/2017 | Eddington | A61H 33/6063 | |
| 2002/0053105 | A1 * | 5/2002 | Turner | A61H 33/6089 | 4/541.1 |
| 2007/0226894 | A1 | 10/2007 | Sato et al. | | |

FOREIGN PATENT DOCUMENTS

| | | | | | |
|---|---|---|---|---|---|
| JP | H7-17185 | U | | 3/1995 | |
| JP | H7-20968 | U | | 4/1995 | |
| JP | 2004-065457 | A | | 3/2004 | |
| JP | 3652762 | B2 | | 5/2005 | |
| JP | 2005-279034 | A | | 10/2005 | |
| JP | 2014-94185 | A | | 5/2014 | |
| JP | 2014-094185 | A | | 5/2014 | |
| JP | 2014-226467 | A | | 12/2014 | |
| JP | 2016-007344 | A | | 1/2016 | |
| WO | WO2014192365 | | * | 12/2014 | A47K 3/02 |

* cited by examiner

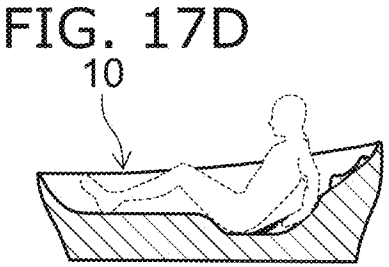
FIG. 17A
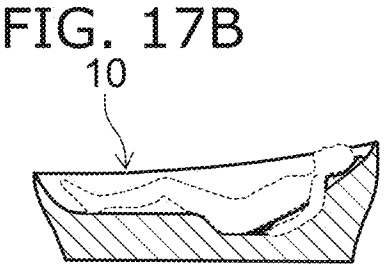
FIG. 17B
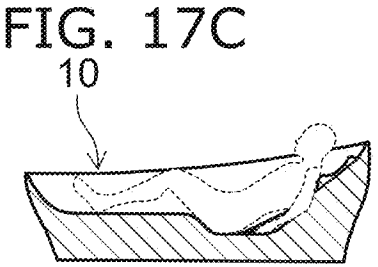
FIG. 17C
FIG. 17D
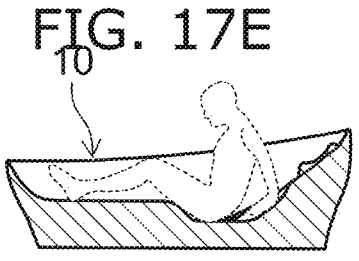
FIG. 17E
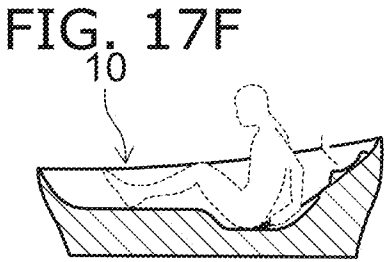
FIG. 17F
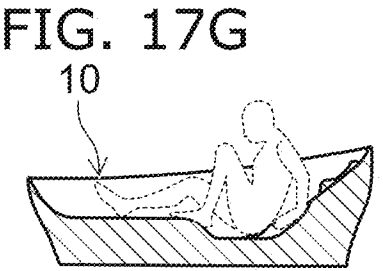
FIG. 17G
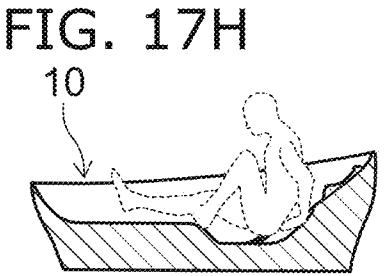
FIG. 17H
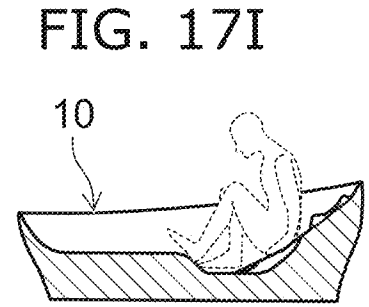
FIG. 17I
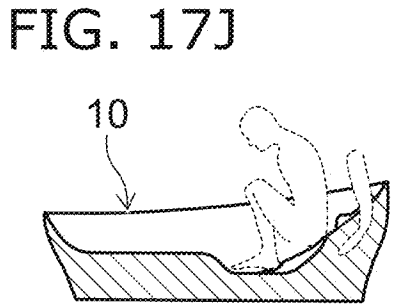
FIG. 17J
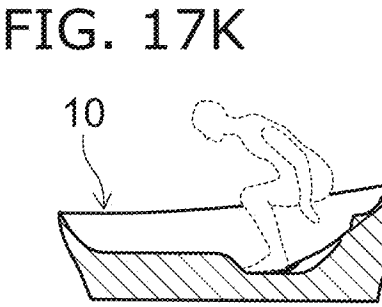
FIG. 17K
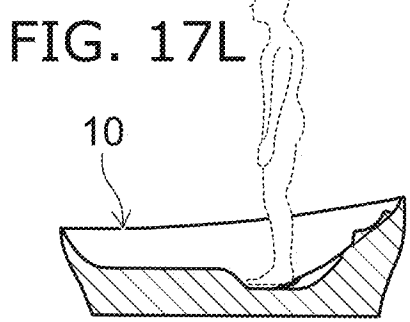
FIG. 17L

BATHTUB

CROSS-REFERENCE TO RELATED APPLICATIONS

This application is a United States National Stage filing under 35 U.S.C. § 371 of International Application No. PCT/JP2017/046949, filed Dec. 27, 2017, which claims the benefit of JP Patent Application No. 2017-036911, filed Feb. 28, 2017 and JP Patent Application No. 2017-219922, filed Nov. 15, 2017, the contents of which are incorporated by reference herein in their entirety. International Application No. PCT/JP2017/046949 was published under PCT Article 21(2) in Japanese.

TECHNICAL FIELD

Embodiments of the invention relate generally to a bathtub.

BACKGROUND ART

A bathtub that includes a water discharger discharging water onto the neck, the shoulders, etc., is known (e.g., Patent Literature 1). For example, in such a bathtub, a massage effect to the neck, the shoulders, etc., can be provided; and the relaxing effect due to bathing can be increased further.

The water discharger is fixed to a bathtub rim, etc. Therefore, according to the physique of the bather, there are cases where hot water cannot be caused to contact a position suited to the neck, the shoulders, etc. In such a case, the bather himself or herself must adjust the posture so that the hot water contacts at the suitable position. Therefore, the posture inside the bathtub undesirably becomes cramped; and there are cases where a sufficient relaxing effect is not obtained.

CITATION LIST

Patent Literature

[Patent Citation 1] JP 2016-7344 A (Kokai)

SUMMARY OF INVENTION

Problem to be Solved by the Invention

The invention is based on a recognition of these problems and is directed to provide a bathtub that includes a water discharger discharging water onto the neck, the shoulders, etc., and can provide a high relaxing effect to bathers of various physiques.

Means for Solving the Problem

A first invention is a bathtub including a bottom surface part, a side surface part, a pillow part, and a water discharger; the side surface part surrounds the bottom surface part, extends upward from the bottom surface part, and includes a backrest part; the pillow part is provided to be movable vertically over a prescribed range along the backrest part; and the water discharger is mounted to the pillow part and provided to be movable vertically along the backrest part with the pillow part.

According to the bathtub, because the water discharger is movable with the pillow part, the water discharge can be performed at a position suited to the physique such as the body height, etc., of the bather. Accordingly, a high relaxing effect can be provided to bathers of various physiques.

A second invention is the bathtub of the first invention, including a water supplier provided in the backrest part, and a water supply functional part supplying, to the water discharger, hot water supplied from the water supplier; and the water supply functional part can supply the hot water supplied from the water supplier even when the water discharger is moving vertically along the backrest part with the pillow part.

According to the bathtub, the pillow part and the water discharger can be moved while causing the water discharger to discharge the hot water; therefore, it is easy to finely adjust the positions of the pillow part and the water discharger according to the physique of the bather.

A third invention is the bathtub of the first invention, including a water supplier provided in the backrest part, and a supply pipe connecting the water discharger and the water supplier and supplying, to the water discharger, hot water supplied from the water supplier; and the supply pipe has flexibility in which a shape of the supply pipe changes according to movement of the water discharger.

According to the bathtub, the supply pipe has flexibility in which the shape of the supply pipe changes according to the movement of the water discharger; therefore, the water discharger can be moved vertically; and the water discharge can be performed at a position suited to the physique of the bather. Accordingly, a high relaxing effect can be provided to bathers of various physiques.

A fourth invention is the bathtub of the third invention, wherein the pillow part covers the supply pipe so that a load from a front does not act on the supply pipe when the pillow part is at any height within the prescribed range.

According to the bathtub, for example, the undesirable mashing and closing of the supply pipe due to a load from the front being undesirably applied to the supply pipe by a part (the head, the back, an arm, etc.) of the body of the bather can be suppressed. Accordingly, the water discharge can be continued smoothly.

A fifth invention is the bathtub of any one of the first to fourth inventions, wherein the water discharger has a laterally-long configuration extending in a left/right direction, and includes a connector to the supply pipe at least at one end in the left/right direction; and the connector extends in the left/right direction from the one end.

According to the bathtub, the connector can be formed easily. For example, the connector can be formed relatively easily even when the connector is formed as one body with the water discharger. For example, the manufacturing cost of the water discharger can be suppressed.

A sixth invention is the bathtub of the fifth invention, wherein the water discharger has a water discharge port extending in the left/right direction and performing a broad water discharge; and the connector is provided at two ends in the left/right direction.

According to the bathtub, the fluctuation of the flow rate of the water discharge in the left/right direction can be suppressed; and a more beautiful broad water discharge can be performed.

A seventh invention is the bathtub of the sixth invention, wherein the water discharger further includes an internal flow channel and a pair of decelerators; the internal flow channel feeds, to the water discharge port, hot water supplied from a pair of the connectors provided at two ends of the internal flow channel; and the pair of decelerators is provided in the internal flow channel to correspond respectively to the pair of connectors, and decelerates a force of the hot water flowing into the internal flow channel from the pair of connectors.

According to the bathtub, when the hot water is supplied to the water discharger from the two sides in the left/right direction, the undesirably high flow rate of the broad water discharge at the central part in the left/right direction can be suppressed. Accordingly, a more beautiful broad water discharge can be performed.

Effects of the Invention

According to an aspect of the invention, a bathtub is provided in which a water discharger discharging water to the neck, the shoulders, etc., is included, and a high relaxing effect can be provided to bathers of various physiques.

BRIEF DESCRIPTION OF DRAWINGS

FIG. 17A to FIG. 17L are descriptive views schematically illustrating an example of a bath exit procedure of the bathtub according to the embodiment.

MODES FOR CARRYING OUT THE INVENTION

Figure 1:
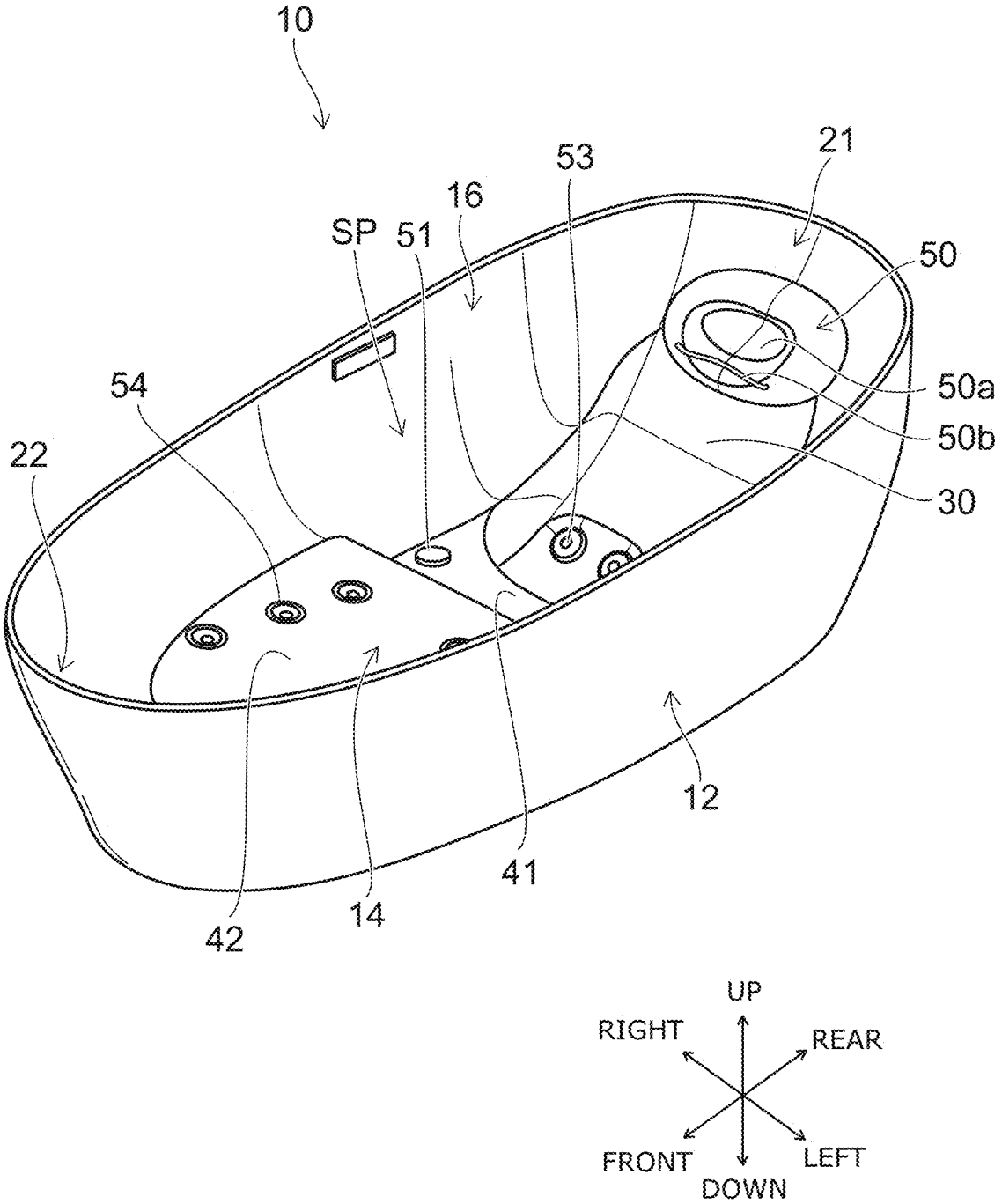
FIG. 1 is perspective view schematically illustrating a bathtub according to the embodiment.

Various embodiments are described below with reference to the accompanying drawings. Similar components in the drawings are marked with the same reference numerals; and a detailed description is omitted as appropriate.

Figure 2:
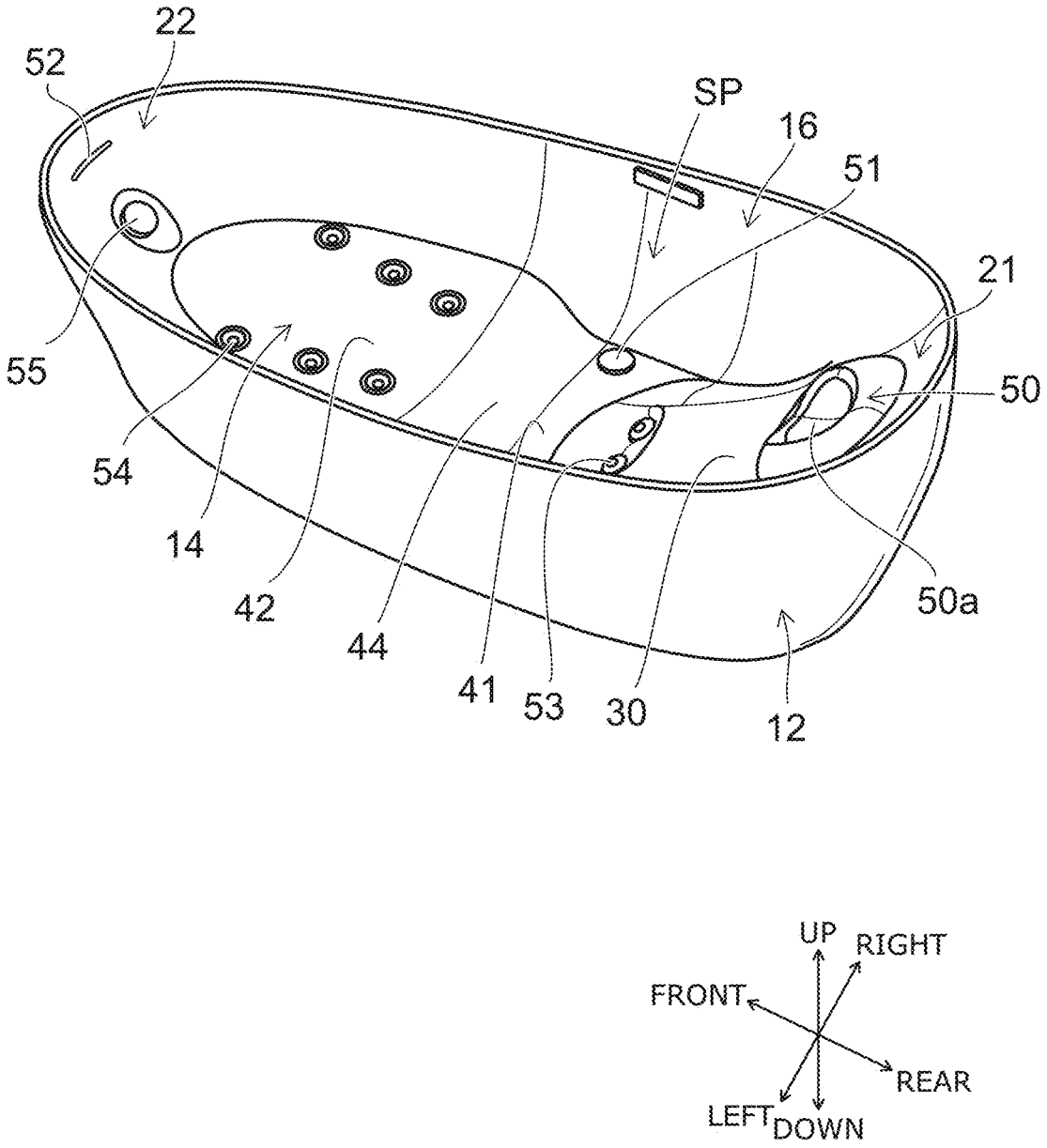
FIG. 2 is perspective view schematically illustrating a bathtub according to the embodiment.

FIG. 1 and FIG. 2 are perspective views schematically illustrating a bathtub according to the embodiment.

As illustrated in FIG. 1 and FIG. 2, the bathtub 10 includes a bathtub main body 12. The bathtub main body 12 includes a bottom surface part 14 and a side surface part 16. The side surface part 16 surrounds the bottom surface part 14 and extends upward from the bottom surface part 14. More specifically, the side surface part 16 surrounds the outer edge of the bottom surface part 14. Thereby, in the bathtub 10, hot water can be accumulated inside a space SP inside the bathtub main body 12 surrounded with the bottom surface part 14 and the side surface part 16; and bathing can be performed inside the bathtub main body 12.

The side surface part 16 has a first inner side surface 21 and a second inner side surface 22. The first inner side surface 21 includes a backrest part 30 supporting the back of the bather. The second inner side surface 22 is disposed at a position facing the first inner side surface 21. In other words, the second inner side surface 22 is the inner side surface at the leg side of the bather having the back contacting the backrest part 30. The bather can bathe in the state in which the back is caused to contact the backrest part 30.

Here, in this specification, when viewed from the bather having the back contacting the backrest part 30, up is taken as "up;" down is taken as "down;" front is taken as "front;" rear is taken as "rear;" the right side is taken as "right;" and the left side is taken as "left."

For example, the backrest part 30 has an inclination angle of 45° or less with respect to the horizontal direction. Thereby, in the bathtub 10, bathing is possible in which the upper body is reclined to be face-up. Hereinbelow, in this specification, the state of bathing with the upper body reclined to be face-up is called "reclined bathing." The bathtub 10 is not limited to a bathtub in which reclined bathing is possible and may be a bathtub for bathing in a posture such as sitting inside the bathtub main body 12.

The configuration of the bathtub main body 12 when viewed from above is an elliptical configuration that is long in the frontward/rearward direction. The configuration of the bathtub main body 12 when viewed from above is not limited to an elliptical configuration and may be a rectangular configuration, a square configuration, a circular configuration, etc. The configuration of the bathtub main body 12 may be any configuration in which reclined bathing is possible.

The bathtub 10 may be a freestanding bathtub used in a constructed bath, etc., or may be a bathtub used in a unit-bath (a system-bath). The method for mounting the bathtub 10 may be any mounting method such as stationary, sunken, half-sunken, etc.

The bottom surface part 14 includes a first bottom surface 41, a second bottom surface 42, and a supporter 44. The first bottom surface 41 is provided between the first inner side surface 21 and the second inner side surface 22. The second bottom surface 42 is provided between the first bottom surface 41 and the second inner side surface 22. The supporter 44 is provided between the first bottom surface 41 and the second bottom surface 42.

The first bottom surface 41 is a surface for placing the buttocks of the bather in the reclined bathing state. The supporter 44 is provided further frontward of the user of which the back is caused to contact the backrest part 30 than are the backrest part 30 and the first bottom surface 41, and is formed to protrude upward from the first bottom surface 41 to suppress frontward movement of the buttocks of the bather in the reclined bathing posture. In other words, the supporter 44 supports the buttocks of the bather in the reclined bathing posture. The second bottom surface 42 is provided frontward of the supporter 44, and is a placement part provided at a position higher than the first bottom surface 41 for placing the legs of the bather.

Thus, the second bottom surface 42 is provided at a position higher than the first bottom surface 41; and the position of the legs of the bather is set to be higher than the position of the buttocks. Thereby, the posture of the bather in the reclined bathing state can approach the posture having the lowest burden on the body for the structure of the musculoskeletal system of a human (hereinbelow, called the "neutral posture"). The bather in the reclined bathing state can be relaxed; and the relaxation effect can be increased further.

The bathtub main body 12 further includes a pillow part 50, a drainage port 51, an overflow port 52, injection ports 53 and 54, and a suction port 55.

The pillow part 50 is provided in the backrest part 30 of the side surface part 16 to be movable in the vertical direction and the frontward/rearward direction over a prescribed range. The pillow part 50 includes a head placement surface 50*a* where the back of the head of the bather in the state in which the face is directed upward can be placed. In the bathtub 10, the position of the head placement surface 50*a* can be adjusted to match the body height, etc., of the bather by moving the pillow part 50 vertically and frontward/rearward along the incline of the backrest part 30. The part of the pillow part 50 lower than the head placement surface 50*a* is curved in a convex curved configuration (referring to FIG. 7). The curved surface part below the head placement surface 50*a* is formed in a curved surface configuration that easily fits into the base of the neck of the bather. It can be easy to support the head of the bather more appropriately thereby.

The pillow part 50 has a water discharge port 50*b*. The water discharge port 50*b* is provided lower than the head placement surface 50*a*. The water discharge port 50*b* discharges hot water toward the neck part of the bather in the state in which the back of the head is placed on the head placement surface 50*a*. Thereby, for example, the neck part of the bather in the reclined bathing state can be warmed. Also, a part of the hot water discharged from the water discharge port 50*b* contacts the neck part of the bather and contacts the shoulders and/or the chest of the bather as well. Thereby, for example, it can be easier to warm the upper body of the bather in the reclined bathing state.

The water discharge port 50*b* is formed in a slit configuration that is long in the left/right direction. The water discharge port 50*b* discharges a water stream having a band configuration extending in the left/right direction. The length in the left/right direction of the water discharge port 50*b* is, for example, about 20 cm-30 cm. The length in the left/right direction of the water discharge port 50*b* is, for example, longer than the average width of the neck of a human. Thereby, the hot water can be caused to appropriately contact the neck part of the bather in the reclined bathing state; and it can be easier to cause the hot water to contact the shoulders, the chest, etc., of the bather.

The drainage port 51 is provided in the first bottom surface 41 of the bottom surface part 14. In other words, the drainage port 51 is provided at the lowest position in the space SP inside the bathtub main body 12. For example, a drain plug that opens and closes the drainage port 51 is provided in the drainage port 51. The hot water can be accumulated inside the bathtub main body 12 by plugging the drainage port 51 with the drain plug. Then, the hot water that has accumulated inside the bathtub main body 12 can be drained externally by opening the drainage port 51.

The overflow port 52 is provided in the upper part of the second inner side surface 22. The position of the overflow port 52 is not limited to the second inner side surface 22 and may be at any position of the side surface part 16. The overflow port 52 communicates with an overflow pipe line 60 (referring to FIG. 6) and allows the hot water to flow into the overflow pipe line 60 when the water level of the hot water inside the bathtub main body 12 (inside the space SP) reaches the height of the overflow port 52. The overflow pipe line 60 causes the hot water flowing through the overflow port 52 to flow into an external drainage pipe, etc. The undesirable overflowing of the hot water outside the bathtub main body 12 can be suppressed thereby.

Thus, the lower end of the overflow port 52 functions as a regulating part regulating the overflow level of the hot water accumulating inside the space surrounded with the bottom surface part 14 and the side surface part 16. The regulating part is not limited to the lower end of the overflow port 52 and may be, for example, the rim of the bathtub main body 12 (the upper end of the bathtub main body 12), etc.

The injection port 53 is provided in the lower part of the backrest part 30. The injection port 53 injects hot water toward the lower back, etc., of the bather in the reclined bathing state. Thereby, the lower back, etc., of the bather can be stimulated; and the relaxation effect can be increased further. In the example, the injection port 53 injects the hot water toward the position of the erector spinae muscle which is an antigravity muscle of the bather. Also, in the example, the bathtub main body 12 includes two injection ports 53 arranged at the left and right. The number of the injection ports 53 is not limited to two and may be one or may be three or more.

The injection port 54 is provided in the second bottom surface 42. In the example, the bathtub main body 12 includes a total of six injection ports 54 having two at the left and right arranged in three sets frontward/rearward. The injection ports 54 are arranged in an upside-down V-shape spreading frontward. The injection ports 54 inject bubbles toward the legs, etc., of the bather in the reclined bathing state. Thereby, the legs, etc., of the bather can be stimulated; and the relaxation effect can be increased further. The number of the injection ports 54 is not limited to six and may be any number.

The suction port 55 is provided lower than the overflow port 52 in the second inner side surface 22. The position of the suction port 55 may be any position lower than the overflow port 52. The suction port 55 suctions the hot water accumulated inside the bathtub main body 12. The bathtub 10 suctions the hot water accumulated inside the bathtub main body 12 through the suction port 55, discharges the suctioned hot water from the water discharge port 50*b* of the pillow part 50, and injects the suctioned hot water from the injection port 53. In other words, the bathtub 10 discharges the hot water from the water discharge port 50*b* and injects the hot water from the injection port 53 by circulating the hot water inside the bathtub main body 12.

Figure 3:
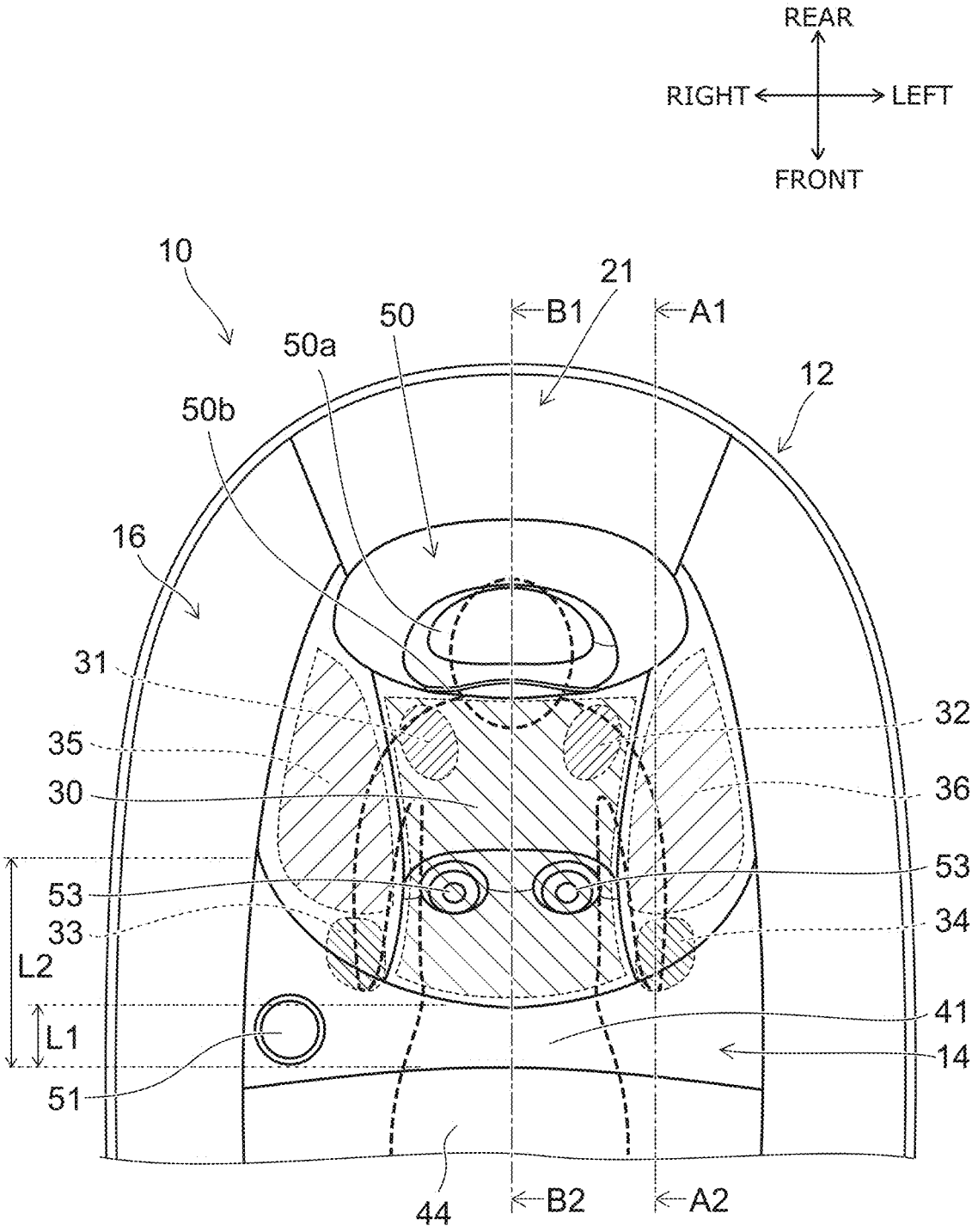
FIG. 3 is a plan view schematically illustrating a part of the bathtub according to the embodiment.

FIG. 3 is a plan view schematically illustrating a part of the bathtub according to the embodiment.

Figure 4:
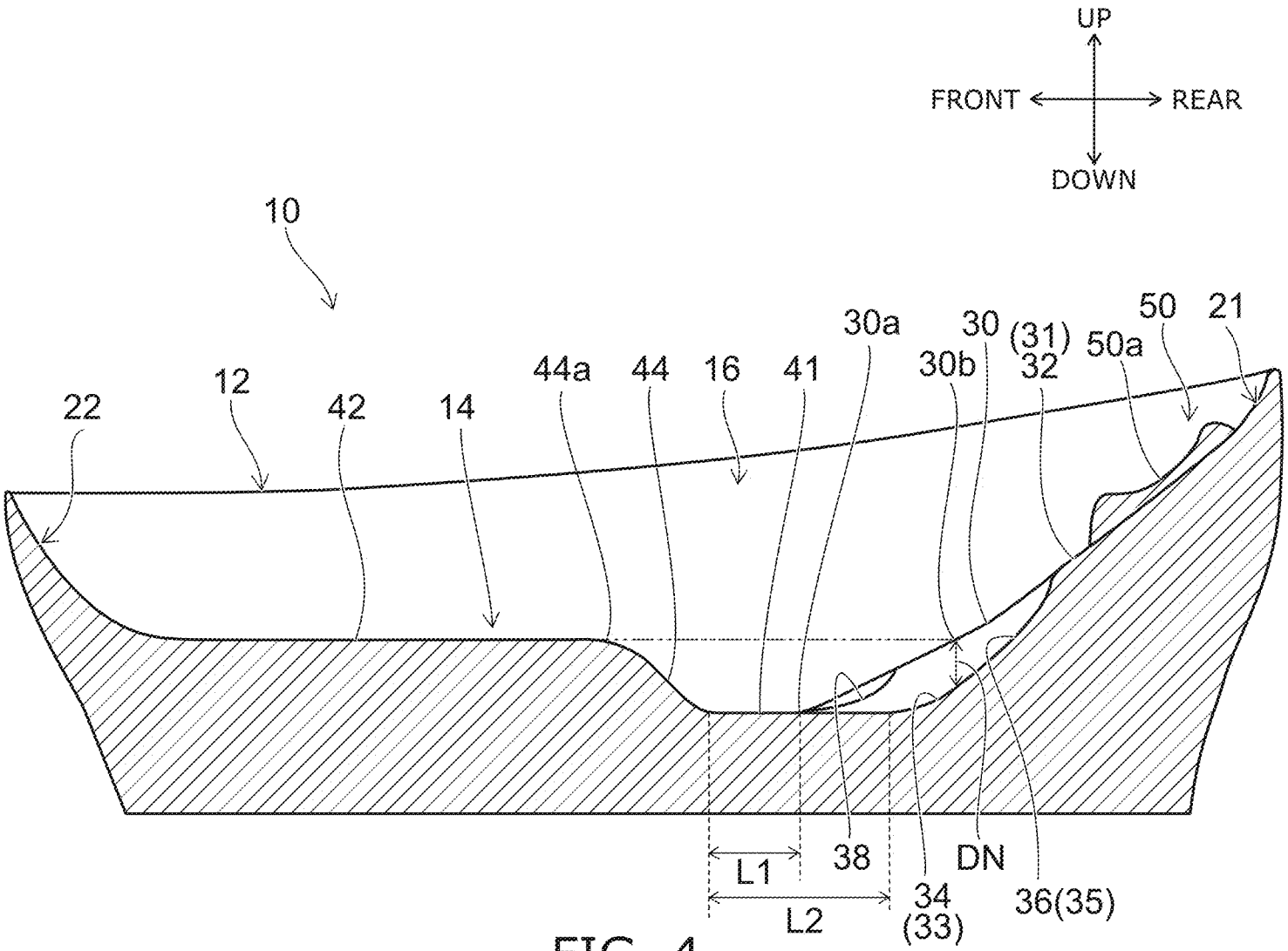
FIG. 4 is a cross-sectional view schematically illustrating a part of the bathtub according to the embodiment.

FIG. 4 is a cross-sectional view schematically illustrating a part of the bathtub according to the embodiment.

FIG. 4 corresponds to a line A1-A2 cross section of FIG. 3.

As illustrated in FIG. 3 and FIG. 4, the first inner side surface 21 further includes a right-side shoulder rest part 31, a left-side shoulder rest part 32, a right-side handrest part 33, a left-side handrest part 34, a right-side trench part 35, and a left-side trench part 36.

The right-side shoulder rest part 31 and the left-side shoulder rest part 32 are provided at both the left and right sides of the upper part of the backrest part 30. The right-side shoulder rest part 31 and the left-side shoulder rest part 32 support the shoulders of the bather in the reclined bathing state. For example, the right-side shoulder rest part 31 and the left-side shoulder rest part 32 are formed as one body with the backrest part 30. Accordingly, the right-side shoulder rest part 31 and the left-side shoulder rest part 32 are flush with the backrest part 30. The right-side shoulder rest part 31 and the left-side shoulder rest part 32 are flush with the backrest part 30 in the left/right direction. Here, "flush" is, for example, the state in which the height difference between the highest point and the lowest point of the two surfaces in a cross section in a plane parallel to the left/right direction and the vertical direction is 10 mm or less. The right-side shoulder rest part 31 and the left-side shoulder rest part 32 may protrude frontward from the backrest part 30. The right-side shoulder rest part 31 and the left-side shoulder rest part 32 may be any configuration that can support the shoulders of the bather in the reclined bathing state.

The right-side handrest part 33 and the left-side handrest part 34 are provided at both the left and right sides of the lower part of the backrest part 30. The hands of the bather in the reclined bathing state can be placed at the right-side handrest part 33 and the left-side handrest part 34.

As illustrated in FIG. 4, the left-side handrest part 34 is inclined downward and toward the front. The configuration of the right-side handrest part 33 is a configuration that is left/right-symmetric to the configuration of the left-side handrest part 34. Accordingly, the right-side handrest part 33 also is inclined downward and toward the front similarly to the left-side handrest part 34.

The right-side trench part 35 and the left-side trench part 36 are provided at both the left and right sides of the central part in the vertical direction of the backrest part 30. The right-side trench part 35 and the left-side trench part 36 are recessed from the backrest part 30 rearward of the bather having the back contacting the backrest part 30. For example, the right-side trench part 35 and the left-side trench part 36 are recessed from the backrest part 30 in a direction orthogonal to the surface of the backrest part 30. In other words, the right-side trench part 35 and the left-side trench part 36 are recessed toward the backside from the backrest part 30.

Thereby, the right-side trench part 35 and the left-side trench part 36 make it possible for the elbows of the bather to be positioned further toward the backside than the backrest part 30 when the bather raises the upper body by pressing on the right-side handrest part 33 and the left-side handrest part 34 with the hands. In other words, the right-side trench part 35 and the left-side trench part 36 can contain the elbows of the bather when the bather raises the upper body by pressing the right-side handrest part 33 and the left-side handrest part 34 with the hands.

As illustrated in FIG. 4, the lower part of the left-side trench part 36 is inclined downward and toward the front and is continuous with the left-side handrest part 34. In other words, the left-side handrest part 34 and the left-side trench part 36 form an inclined surface continuously inclined downward and toward the front. The configuration of the right-side trench part 35 is a configuration that is left/right-symmetric to the configuration of the left-side trench part 36. The lower part of the right-side trench part 35 is inclined downward and toward the front similarly to the left-side trench part 36 and is continuous with the right-side handrest part 33.

The inclination angle with respect to the horizontal direction of the lower part of the right-side trench part 35 and the lower part of the left-side trench part 36 is larger than the inclination angle with respect to the horizontal direction of the right-side handrest part 33 and the left-side handrest part 34. For example, the right-side handrest part 33, the left-side handrest part 34, the right-side trench part 35, and the left-side trench part 36 have concave curved configurations recessed toward the backside. Accordingly, the inclination angle of the right-side trench part 35 is larger than the inclination angle of the right-side handrest part 33. The inclination angle of the left-side trench part 36 is larger than the inclination angle of the left-side handrest part 34.

The inclination angle with respect to the horizontal direction of the right-side handrest part 33 and the left-side handrest part 34 is, for example, 10° or more. The inclination angle with respect to the horizontal direction of the lower part of the right-side trench part 35 and the lower part of the left-side trench part 36 is, for example, 10° or more. The right-side handrest part 33, the left-side handrest part 34, the right-side trench part 35, and the left-side trench part 36 are not limited to curved configurations and may have linear inclined surface configurations.

A depth DN of the right-side trench part 35 and the left-side trench part 36 from the backrest part 30 is, for example, not less than 2 cm and not more than 20 cm. Thereby, when raising the upper body, the elbows of the bather can be contained appropriately; the right-side trench part 35 and the left-side trench part 36 can be suppressed from being excessively deep; and the undesirable difficulty of reaching the parts of the right-side trench part 35 and the left-side trench part 36 with the hands and/or the elbows can be suppressed. For example, the upper body of the bather can be easier to raise.

As illustrated in FIG. 4, the first bottom surface 41 is substantially horizontal in the frontward/rearward direction. In other words, the first bottom surface 41 that is provided between the backrest part 30 and the supporter 44 is linked to the lower end of the supporter 44, and is a horizontal part that is horizontal in the frontward/rearward direction. Here, "horizontal" is, for example, the state in which the angle of the line segment connecting the highest point and the lowest point in the surface is 10° or less.

The supporter 44 is inclined upward and toward the front. The inclination angle with respect to the horizontal direction of the supporter 44 is larger than the inclination angle with respect to the horizontal direction of the backrest part 30 at the same height. As described above, the inclination angle with respect to the horizontal direction of the backrest part 30 is 45° or less. Conversely, the inclination angle with respect to the horizontal direction of the supporter 44 is, for example, greater than 45° and less than 90°.

A lower end 30*a* of the backrest part 30 is linked to the first bottom surface 41 which is the horizontal part. Over the entire part of the backrest part 30 from a position 30*b* at the same height as an upper end 44*a* of the supporter 44 to the first bottom surface 41 (the lower end 30*a*), the inclination angle with respect to the horizontal direction of the backrest part 30 is smaller than the inclination angle with respect to the horizontal direction of the supporter 44 at the same height.

In the example, the first bottom surface 41 is horizontal also in the left/right direction (referring to FIG. 3). The first bottom surface 41 is a substantially horizontal surface. A length L2 in the frontward/rearward direction of the two side parts of the first bottom surface 41 is longer than a length L1 in the frontward/rearward direction of the central part of the first bottom surface 41. For example, the first bottom surface 41 may be inclined about several degrees in a downward incline toward the drainage port 51. The first bottom surface 41 may have a so-called drainage gradient.

Also, in the example, the second bottom surface 42 which is the placement part for placing the legs of the bather also is substantially horizontal. The second bottom surface 42 is a horizontal surface that is substantially horizontal in the frontward/rearward direction and the left/right direction. The bottom surface part 14 is horizontal over the entire part frontward of the supporter 44.

Figure 5:
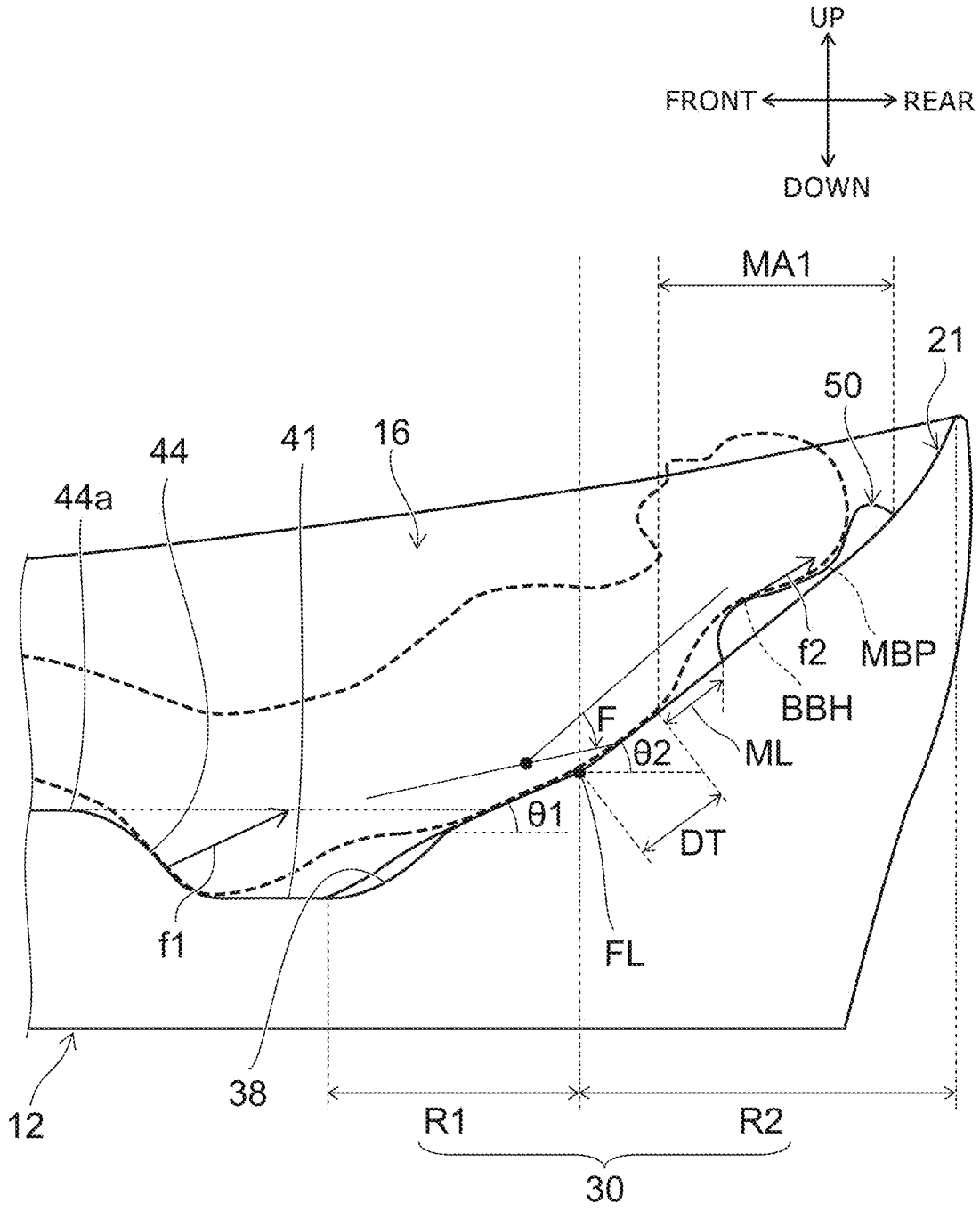
FIG. 5 is a cross-sectional view schematically illustrating an enlargement of a part of the bathtub according to the embodiment.

FIG. 5 is a cross-sectional view schematically illustrating an enlargement of a part of the bathtub according to the embodiment.

As illustrated in FIG. 5, the backrest part 30 includes a first region R1 and a second region R2. The second region R2 is provided to be continuous above the first region R1. Also, the backrest part 30 includes a flexure line FL. The flexure line FL is provided at the boundary part between the first region R1 and the second region R2. The second region R2 is bent with respect to the first region R1. The flexure line FL extends in a line configuration in the left/right direction and is a bent part where the inclination angle of the backrest part 30 changes. For example, the flexure line FL is provided at a position that is higher than the upper end 44*a* of the supporter 44. Here, "bend" is, for example, the state in which two surfaces having different inclination angles are connected by a bevel or a round-over having a radius of 2 cm or less.

An inclination angle θ2 with respect to the horizontal direction of the second region R2 is larger than an inclination angle θ1 with respect to the horizontal direction of the first region R1. The inclination angle θ1 of the first region R1 is, for example, not less than 10° and not more than 45°. The inclination angle θ2 of the second region R2 is, for example, the angle of the inclination angle θ1 to which an angle not less than 5° and not more than 30° is added.

The first region R1 and the second region R2 may have inclined surface configurations or may have curved configurations. Also, the backrest part 30 may not always be bent. For example, the backrest part 30 may have a concave curved configuration that is concave downward. Thereby, similarly to the case of being bent, the inclination angle of the upper part of the backrest part 30 can be larger than the inclination angle of the lower part of the backrest part 30. The backrest part 30 may have any configuration in which the inclination angles are different between the lower part and the upper part. For example, it is sufficient for the inclination angle with respect to the horizontal direction of the line segment connecting the lower end and the upper end of the first region R1 to be different from the inclination angle with respect to the horizontal direction of the line segment connecting the lower end and the upper end of the second region R2 in a cross section parallel to the frontward/rearward direction and the vertical direction.

The backrest part 30 includes an abrupt incline part 38. The abrupt incline part 38 is provided between the first bottom surface 41 and the lower center of the backrest part 30. The inclination angle with respect to the horizontal direction of the abrupt incline part 38 is larger than the inclination angle with respect to the horizontal direction of the lower center of the backrest part 30. For example, the inclination angle θ1 of the first region R1 is the inclination angle in the first region R1 of the part above the abrupt incline part 38.

The pillow part 50 is provided in the second region R2. The pillow part 50 moves vertically and frontward/rearward within a prescribed range MA1 inside the second region R2. In other words, the pillow part 50 moves in the inclination direction of the backrest part 30 within the prescribed range MA1. FIG. 5 illustrates the state in which the pillow part 50 is at the highest position. A distance ML that the pillow part 50 moves along the backrest part 30 is, for example, 155 mm or more.

The flexure line FL is provided at a prescribed spacing DT below the lower end of the pillow part 50 at the lowest position. The prescribed spacing DT is, for example, 100 mm or more. More specifically, the length along the backrest part 30 of the prescribed spacing DT is 100 mm or more. More favorably, the length along the backrest part 30 of the prescribed spacing DT is not less than 140 mm and not more than 200 mm.

Also, as illustrated in FIG. 5, by setting the inclination angle of the second region R2 to be larger than the inclination angle of the first region R1, the back (the spine) of the bather can be bent by the second region R2 while the first region R1 provides the bather with a reclined bathing sensation. Thereby, the bather can obtain a force pressing the body to the backrest part 30 and the supporter 44 by utilizing a "spring force F of the back urging the back to straighten" that unconsciously acts on the bather in the state in which the back is bent.

The supporter 44 supports the buttocks of the bather in the reclined bathing state and provides, to the body (the buttocks) of the bather, a force f1 in the reverse orientation of the direction of the body of the bather slipping downward along the incline of the backrest part 30. Also, the pillow part 50 supports a lower part BBH (the base part between the head and the neck) of the back of the head of the bather in the reclined bathing state and provides, to the body (the head) of the bather, a force f2 in the reverse orientation of the direction of the body of the bather slipping downward along the incline of the backrest part 30. In other words, the lower part BBH of the back of the head is caught by the pillow part 50 against the direction of slipping downward.

Thus, while supporting the buttocks of the bather by the supporter 44, the bather is pressed to the backrest part 30 by utilizing the spring force F of the back unconsciously acting on the bather by appropriately bending the back of the bather. Thereby, the bather can be caused to relax appropriately; and reclined bathing can be performed in a more relaxed state. Also, because the lower part BBH of the back of the head of the bather is caught by the pillow part 50, the bather can be caused to be more relaxed; and reclined bathing can be performed in an even more relaxed state.

The configuration of the pillow part 50 may be any configuration such that at least the lower part BBH of the back of the head of the bather can be placed (can be supported). The head placement surface 50*a* may be a surface of any configuration such that the lower part BBH of the back of the head of the bather can be placed in the state in which the face is directed upward. For example, an occipital point MBP (the part of the back of the head jutting most rearward) of the bather may contact the backrest part 30 in the state in which the lower part BBH of the back of the head of the bather is placed on the pillow part 50.

It is favorable for the flexure line FL to be disposed at a position so that the back of the bather is bent at a position as proximal as possible to the lower back of the bather. Thereby, for example, compared to the case where the back of the bather is bent at a position proximal to the chest of the bather, the undesirable sensations of the bather such as difficulty breathing due to the bending of the back, etc., can be suppressed. The bather can perform reclined bathing while being more relaxed.

Figure 6:
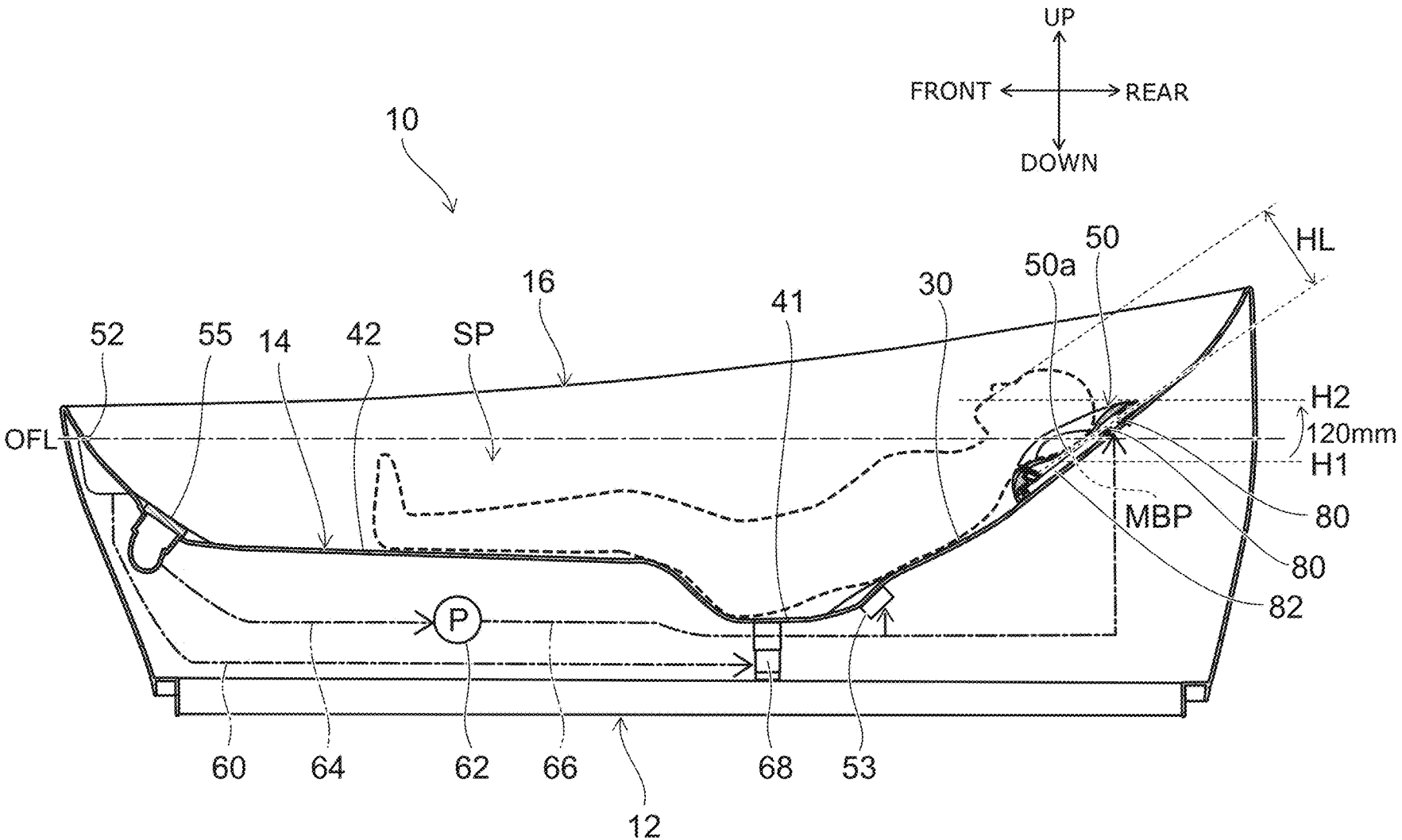
FIG. 6 is a cross-sectional view schematically illustrating a part of the bathtub according to the embodiment.

FIG. 6 is a cross-sectional view schematically illustrating a part of the bathtub according to the embodiment.

FIG. 6 corresponds to a line B1-B2 cross section of FIG. 3.

As illustrated in FIG. 6, the lower end of the overflow port 52 which is the regulating part regulating an overflow level OFL of the water inside the bathtub main body 12 is provided lower than a position H2 which is 120 mm higher than a position H1 of the head placement surface 50*a* in the state in which the pillow part 50 is disposed at the lowest position. More specifically, the position H1 is the position of the lower end of the head placement surface 50*a* in the state in which the pillow part 50 is disposed at the lowest position.

The 5%-tile value of a length HL from the back of the head (the occipital point MBP) to the mouth is about 195 mm for an adult Asian female whose body height is relatively short globally speaking. More specifically, the length HL is the length from the occipital point MBP to the mouth in a direction perpendicular to the coronal plane (the plane splitting the human body into the ventral side and the dorsal side). In other words, this is the length in the frontward/rearward direction (the horizontal direction) from the occipital point MBP to the mouth of a human in the state of standing erect and facing the front. Considering the inclination of the reclined bathing and the state in which the chin is drawn inward, the length in the height direction from the head placement surface 50*a* to the mouth is about 120 mm or more. Accordingly, the overflow port 52 is provided lower than the position H2 which is 120 mm higher than the position H1 of the head placement surface 50*a* in the state in which the pillow part 50 is disposed at the lowest position. Thereby, even when a bather having a relatively small physique sets the height of the pillow part 50 to the lowest position and adds hot water into the bathtub main body 12, etc., the water level of the hot water inside the bathtub main body 12 exceeding the mouth of the bather can be suppressed; and undesirable discomfort of the bather can be suppressed.

For example, for the lower end (the regulating part) of the overflow port 52, it is favorable to set the overflow level OFL to be between the position H1 and the position H2. Thereby, for example, when a bather that has a relatively tall body height sets the height of the pillow part 50 to the highest position and performs reclined bathing, etc., the undesirable excessive jutting of the shoulders and/or the chest of the bather above the water surface can be suppressed. Accordingly, bathers of various physiques can perform reclined bathing comfortably.

As illustrated in FIG. 6, the bathtub 10 further includes the overflow pipe line 60, a pump 62, and circulation pipes 64 and 66.

The overflow pipe line 60 is connected to the overflow port 52. Also, the overflow pipe line 60 is connectable to a drainage pipe 68 connected below the drainage port 51. The overflow pipe line 60 causes the hot water flowing through the overflow port 52 to flow into the drainage pipe 68.

The pump 62 is connected to the suction port 55 via the circulation pipe 64 and is connected to the pillow part 50 and the injection port 53 via the circulation pipe 66. The pump 62 supplies the hot water suctioned through the suction port 55 to the pillow part 50 and the injection port 53. Thereby, according to the driving of the pump 62, the hot water is discharged from the water discharge port 50*b* of the pillow part 50; and the hot water is injected from the injection port 53. In other words, the pump 62 is a pump for circulating the hot water inside the space SP of the bathtub main body 12. The circulation pipes 64 and 66 are connected to the pump 62 and pass the circulating hot water.

For example, the pump 62 is provided in the space below the second bottom surface 42. Thus, by disposing the pump 62 below the second bottom surface 42 which is a position separated from the backrest part 30, it is difficult for the bather to hear the operation sound of the pump 62; and the decrease of the relaxing effect due to the operation sound of the pump 62 can be suppressed. Also, by disposing the pump 62 in the space below the second bottom surface 42, it is unnecessary to reduce the front, rear, left, and right lengths inside the bathtub main body 12; and the spaciousness inside the bathtub main body 12 also can be ensured.

In the example, the hot water is discharged from the injection port 53 and from the water discharge port 50*b* of the pillow part 50 by the driving of one pump 62. For example, by providing a three-way valve or the like at the branch part between the water discharge port 50*b* and the injection port 53, the hot water may be supplied selectively only to one of the water discharge port 50*b* or the injection port 53. Or, the hot water may be discharged from only one of the water discharge port 50*b* or the injection port 53 by individually providing pumps respectively to the water discharge port 50*b* and the injection port 53.

Figure 7:
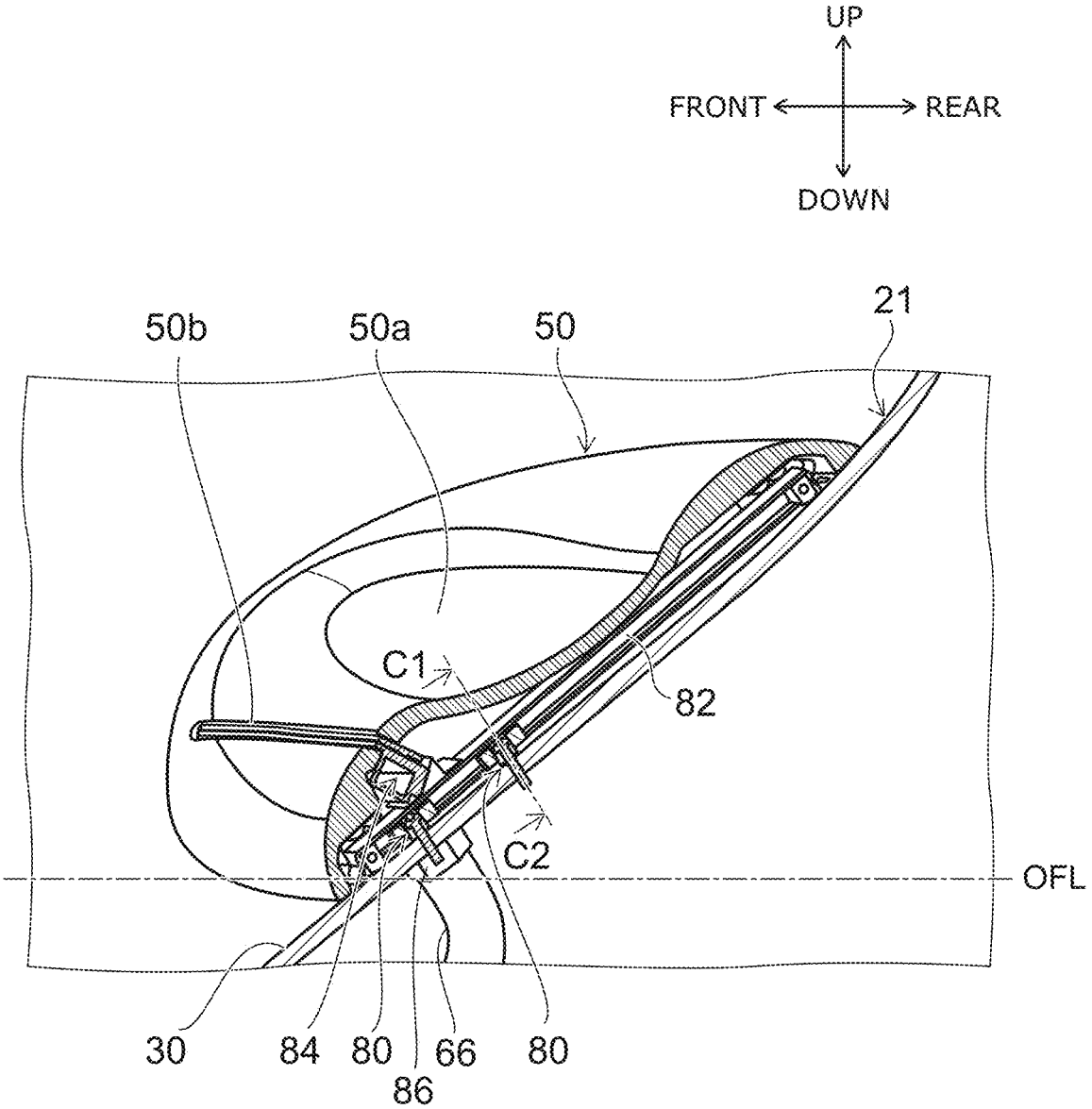
FIG. 7 is a cross-sectional view schematically illustrating an enlargement of a part of the pillow part of the bathtub according to the embodiment.

FIG. 7 is a cross-sectional view schematically illustrating an enlargement of a part of the pillow part of the bathtub according to the embodiment.

As illustrated in FIG. 7, the bathtub 10 further includes a supporter 80, an axial part 82, and a water discharger 84. The bathtub 10 includes, for example, two supporters 80 disposed to be arranged in the vertical direction and the frontward/rearward direction. The supporters 80 are provided at the backrest part 30 of the bathtub main body 12. The supporters 80 are disposed at the backrest part 30 to be higher than the overflow level OFL regulated by the overflow port 52 (referring to FIG. 6).

Figure 8A:
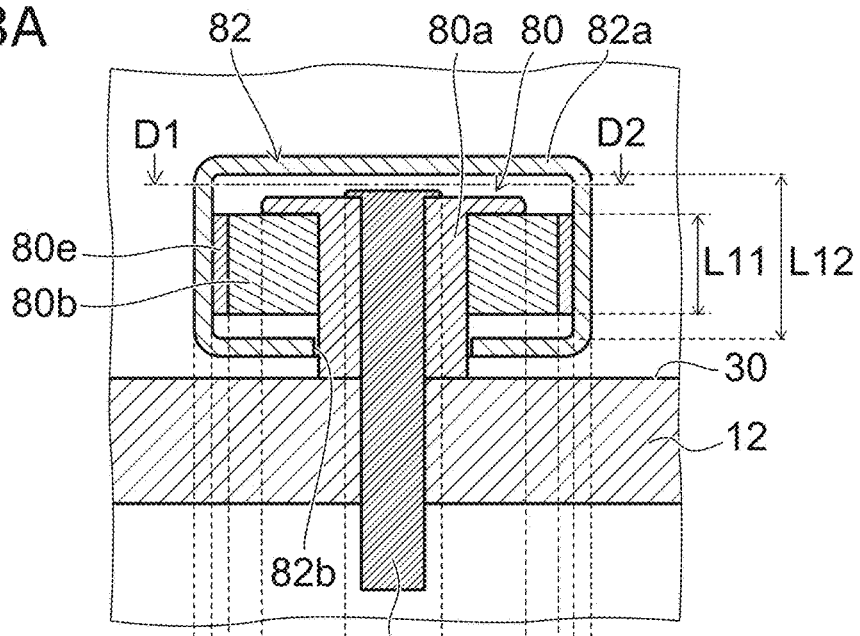
FIG. 8A to FIG. 8C are cross-sectional views schematically illustrating enlargements of parts of the pillow part of the bathtub according to the embodiment.
Figure 8B:
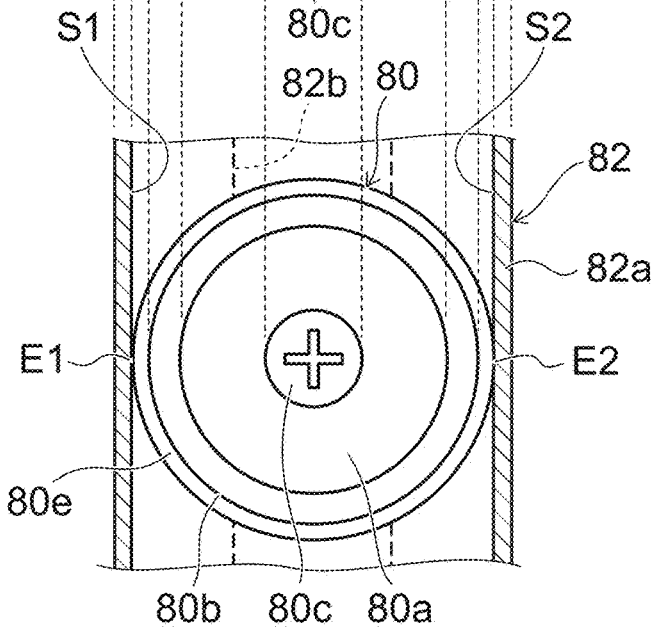
Figure 8C:
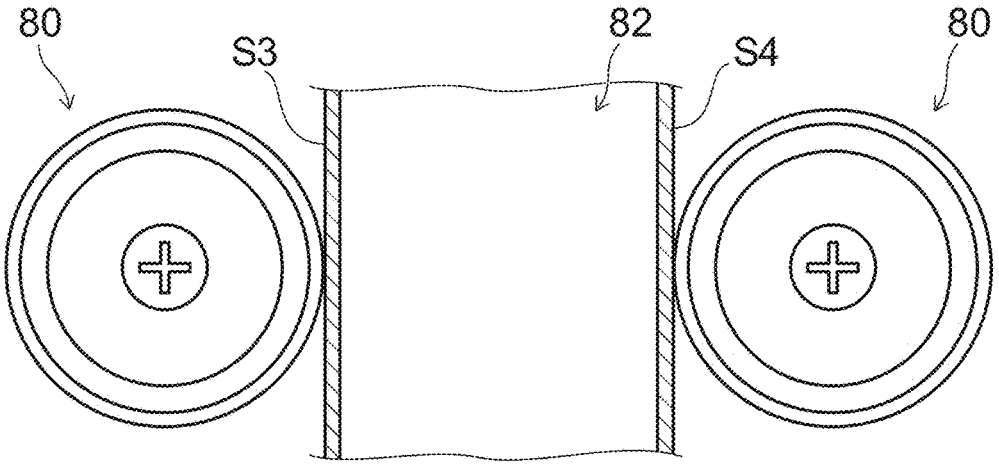

FIG. 8A to FIG. 8C are cross-sectional views schematically illustrating enlargements of parts of the pillow part of the bathtub according to the embodiment.

FIG. 8A corresponds to a line C1-C2 cross section of FIG. 7.

FIG. 8B corresponds to a line D1-D2 cross section of FIG. 8A.

As illustrated in FIG. 8A and FIG. 8B, the supporter 80 includes a protruding part 80*a*, a contained part 80*b*, a screw 80*c*, and a sliding member 80*e*. The protruding part 80*a* protrudes from the backrest part 30. For example, the protruding part 80*a* protrudes in a direction perpendicular to the backrest part 30. The protruding part 80*a* has a substantially cylindrical configuration. The protruding part 80*a* is mounted to the bathtub main body 12 by the screw 80*c*. In other words, the supporter 80 is fastened with a screw to the bathtub main body 12. The method for mounting the supporter 80 is not limited to that recited above and may be any method in which mounting to the bathtub main body 12 is possible. The configuration of the protruding part 80*a* is not limited to a cylindrical configuration and may be any configuration.

The contained part 80*b* is mounted to the upper part of the protruding part 80*a* with a prescribed spacing between the contained part 80*b* and the bathtub main body 12. The contained part 80*b* protrudes at least in the left/right direction from the tip side of the protruding part 80*a*. The configuration of the contained part 80*b* when viewed from above is, for example, a circular configuration. Accordingly, in the example, the contained part 80*b* protrudes in the left/right direction and the frontward/rearward direction from the tip side of the protruding part 80*a*. The configuration of the contained part 80*b* may be any configuration that protrudes in at least the left/right direction from the tip side of the protruding part 80*a*.

The left and right end parts of the contained part 80*b* are elastic. For example, an elastic material such as rubber or the like is included in the contained part 80*b*. In such a case, substantially the entire contained part 80*b* is elastic.

The sliding member 80*e* is mounted to the contained part 80*b*. The sliding member 80*e* is positioned at least at the left and right end parts of the contained part 80*b*. In the example, the configuration of the sliding member 80*e* when viewed from above is a ring configuration. In such a case, the sliding member 80*e* surrounds the outer perimeter of the circular contained part 80*b*. In other words, the contained part 80*b* is disposed inside the ring-shaped sliding member 80*e*.

Elastic deformation of the sliding member 80*e* is possible following the elastic deformation of the contained part 80*b*. However, it is desirable to use, as the material of the sliding member 80*e*, a material that is harder than the elastic material of the contained part 80*b*. In other words, the elastic modulus (the rigidity modulus) of the material of the sliding member 80*e* is higher than the elastic modulus of the elastic material of the contained part 80*b*. For example, the sliding member 80*e* includes a resin such as polyacetal (POM), etc.

Figure 9A:
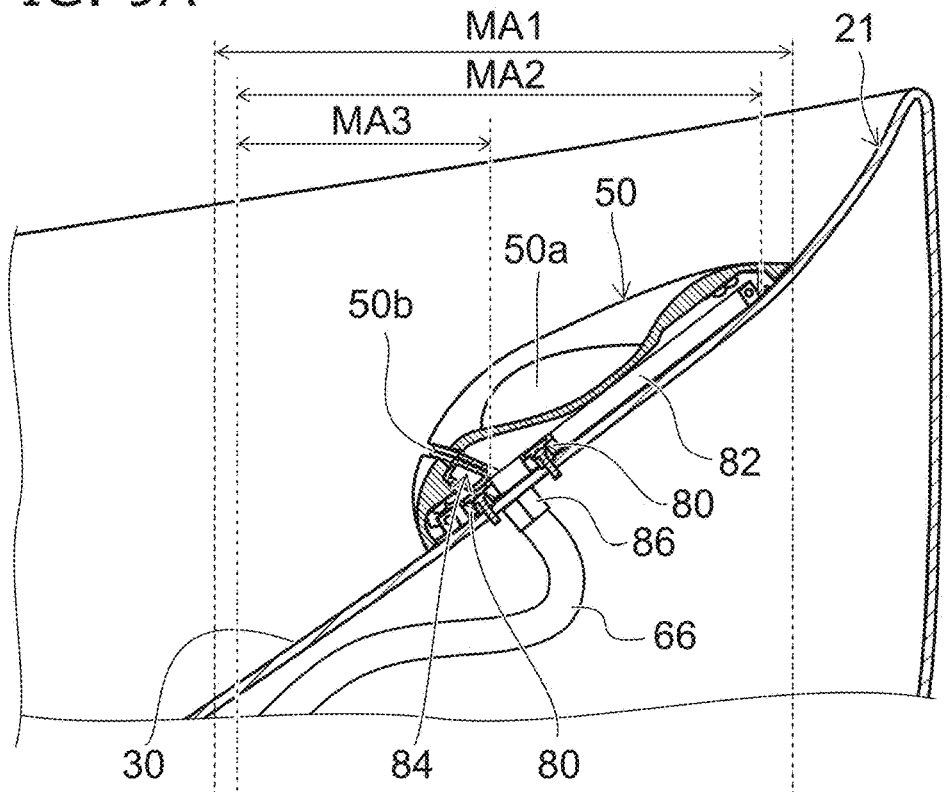
FIG. 9A and FIG. 9B are cross-sectional views schematically illustrating an enlargement of a part of the pillow part of the bathtub according to the embodiment.
Figure 9B:
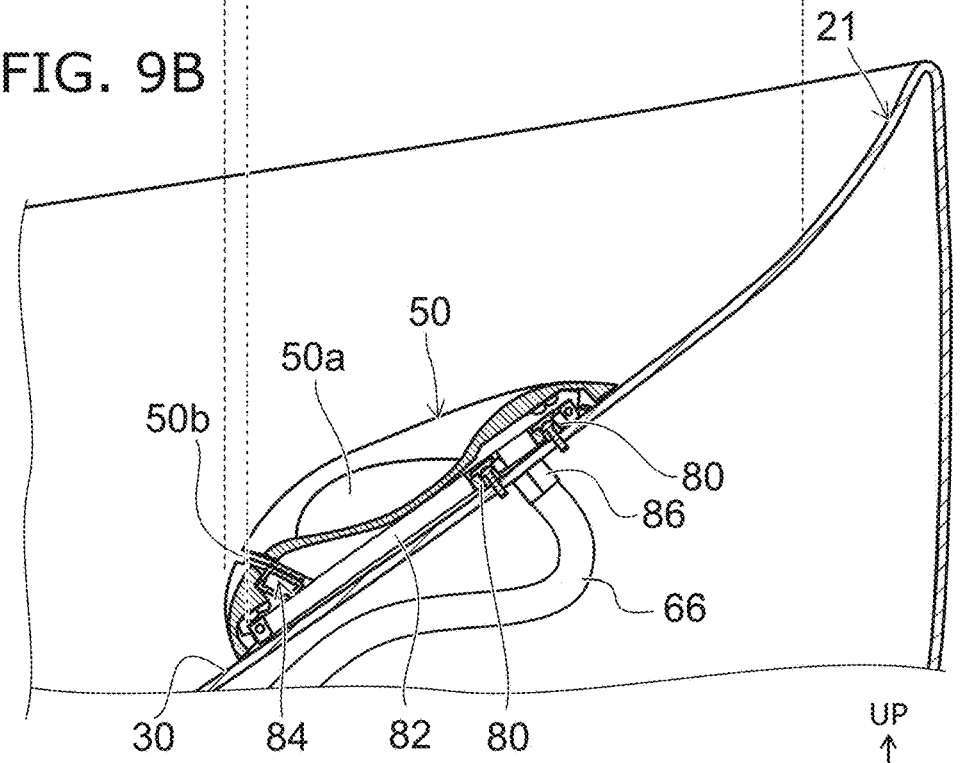
Figure 9B:
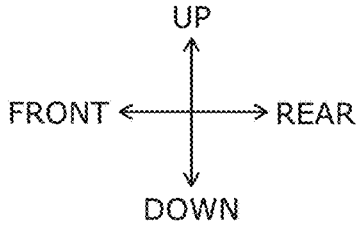

Because the axial part 82 extends in the vertical direction and the frontward/rearward direction and is supported by the supporter 80 to be movable in the vertical direction only in a partial range in the vertical direction and the frontward/rearward direction, the axial part 82 moves along the backrest part 30 over a prescribed range MA2 in the vertical direction and the frontward/rearward direction (referring to FIG. 9). In other words, the axial part 82 moves in the inclination direction of the backrest part 30.

The axial part 82 includes a tubular part 82*a* and an opening 82*b*. The tubular part 82*a* is provided in a tubular configuration that can contain at least a part of the protruding part 80*a*. The tubular part 82*a* is a tubular configuration that can contain the contained part 80*b* and the sliding member 80*e* of the supporter 80. In other words, the contained part 80*b* is the part of the protruding part 80*a* contained in the tubular part 82*a*. For example, the tubular part 82*a* has a quadrilateral tubular configuration. The configuration of the tubular part 82*a* may be any configuration that corresponds to the configuration of the contained part 80*b*, etc.

The opening 82*b* is provided in the backrest part 30 side of the tubular part 82*a*. The opening 82*b* extends in the vertical direction and the frontward/rearward direction. In other words, the opening 82*b* causes the tubular part 82*a* to be open downward. The opening 82*b* allows the protruding part 80*a* to be insertable in the state in which the tubular part 82*a* contains the contained part 80*b*. Thereby, the opening 82*b* allows the tubular part 82*a* to be movable in the vertical direction and the frontward/rearward direction along the backrest part 30.

The lateral width (the width in the left/right direction) of the opening 82*b* is wider than the lateral width of the protruding part 80*a* and narrower than the lateral widths of the contained part 80*b* and the sliding member 80*e*. Thereby, the contained part 80*b* and the sliding member 80*e* can be contained in the tubular part 82*a*; and the protruding part 80*a* can be inserted into the opening 82*b*. The contained part 80*b* and the sliding member 80*e* that are contained inside the tubular part 82*a* engage the tubular part 82*a* in the left/right direction. In other words, the sliding member 80*e* contacts the contained part 80*b* and the tubular part 82*a* and is clamped between the contained part 80*b* and the tubular part 82*a* in the left/right direction. The movement of the axial part 82 in the left/right direction is regulated thereby. Also, a part of the tubular part 82*a* enters between the contained part 80*b* and the backrest part 30. The movement of the axial part 82 in a direction perpendicular to the backrest part 30 is regulated thereby. In other words, undesirably detaching of the axial part 82 from the supporter 80 in the direction perpendicular to the backrest part 30 is suppressed. Accordingly, the axial part 82 can move only in the vertical direction and the frontward/rearward direction (the inclination direction of the backrest part 30).

Left and right inner side surfaces S1 and S2 of the tubular part 82*a* (the axial part 82) are formed in planar configurations. The supporter 80 supports the axial part 82 to be slidable in the vertical direction and the frontward/rearward direction by left and right end parts E1 and E2 of the sliding member 80*e* pressing the left and right inner side surfaces S1 and S2 of the tubular part 82*a* formed in the planar configurations. The width between the left and right inner side surfaces S1 and S2 of the tubular part 82*a* is slightly narrower than the width between the left and right end parts E1 and E2 of the sliding member 80*e* (the outer diameter of the sliding member 80*e*). The tubular part 82*a* contains the contained part 80*b* and the sliding member 80*e* in the interior space and causes a slight elastic deformation of the contained part 80*b* and the sliding member 80*e*. The elastic force of the contained part 80*b* is transferred to the tubular part 82*a* via the sliding member 80*e*. Thereby, the left and right inner side surfaces S1 and S2 of the tubular part 82*a* can be pressed by the contained part 80*b* via the left and right end parts E1 and E2 of the sliding member 80*e*. The axial part 82 can be stopped at any position within the prescribed range MA2 by the elastic force of the contained part 80*b*. Here, it is favorable for the thickness of the sliding member 80*e* to be thin, e.g., about 1 to 2 mm. Thereby, the sliding member 80*e* deforms easily following the contained part 80*b*; and the elastic force of the contained part 80*b* is transferred efficiently.

Also, the user can move the axial part 82 with the pillow part 50 along the backrest part 30 by applying a force to the pillow part 50 mounted to the axial part 82. In such a case, by providing the sliding member 80*e*, the movement of the axial part 82 can be smooth. In other words, compared to the case of direct contact between the axial part 82 and the contained part 80*b*, because the sliding member 80*e* slides easily with respect to the axial part 82, the resistance that is generated when sliding the axial part 82 can be reduced. Also, by providing the sliding member 80*e*, the wear of the contained part 80*b* can be suppressed.

A length L11 of the contained part 80*b* in a direction perpendicular to the backrest part 30 is shorter than a length L12 of the interior of the tubular part 82*a* in the direction perpendicular to the backrest part 30. Also, the length of the sliding member 80*e* perpendicular to the backrest part 30 is substantially the same as the length L11. Thereby, the axial part 82 can move in the direction perpendicular to the backrest part 30 by the amount of the difference between the length L11 and the length L12 in the state in which the contained part 80*b* is contained inside the tubular part 82*a*. In other words, the supporter 80 supports the axial part 82 to be movable in the vertical direction and the frontward/rearward direction and supports the axial part 82 to be movable also in the direction perpendicular to the backrest part 30.

In the example, two supporters 80 are provided to be arranged in the frontward/rearward direction. The number of the supporters 80 may be one or may be three or more. The number of the supporters 80 may be any number that can support the axial part 82 to be movable. The configuration of the supporter 80 and the configuration of the axial part 82 are not limited to those recited above and may be any configuration for which the axial part 82 can be moved. For example, as illustrated in FIG. 8C, the axial part 82 may be slidably supported by forming left and right outer side surfaces S3 and S4 of the axial part 82 in planar configurations and by pressing the left and right outer side surfaces S3 and S4 formed in the planar configurations. In other words, the axial part 82 may be slidably supported by being clamped. In such a case, one supporter 80 may clamp the axial part 82; or the axial part 82 may be clamped by a pair of supporters 80 as illustrated in FIG. 8C.

FIG. 9A and FIG. 9B are cross-sectional views schematically illustrating an enlargement of a part of the pillow part of the bathtub according to the embodiment.

As illustrated in FIG. 7, FIG. 9A, and FIG. 9B, the pillow part 50 is mounted to the axial part 82. Thereby, the pillow part 50 moves in the vertical direction and the frontward/rearward direction along the incline of the backrest part 30 between the highest position illustrated in FIG. 9A and the lowest position illustrated in FIG. 9B. Also, the pillow part 50 and the axial part 82 can be stopped at any position between the highest position and the lowest position by the friction force generated between the axial part 82 and the sliding members 80*e*.

The movable support of the axial part 82 by the supporter 80 is not limited to a configuration utilizing friction forces. For example, the configuration of the supporter 80 may be a configuration in which the axial part 82 is engaged using a latch mechanism, a gear mechanism, etc., and the axial part 82 is stopped at any position between the highest position and the lowest position by moving the axial part 82 while changing the engaged state (the position of the engagement) by applying a force, etc. Thus, the supporter 80 may movably support the axial part 82 by engagement mounting.

The water discharger 84 is mounted in the pillow part 50 and discharges water toward the neck part of the bather. The state in which the water discharger 84 is mounted in the pillow part 50 may not be a state in which the water discharger 84 is directly mounted to the pillow part 50, and includes a state in which the water discharger 84 is disposed between the pillow part 50 and the backrest part 30 as illustrated in FIG. 7. More specifically, the water discharger 84 is provided lower than the head placement surface 50*a* of the pillow part 50. The water discharger 84 is mounted to the axial part 82. Thereby, the water discharger 84 follows the movement of the pillow part 50. The water discharger 84 moves in the inclination direction of the backrest part 30. In other words, the water discharger 84 is provided to be movable with the pillow part 50 vertically over a prescribed range MA3 along the backrest part 30. The water discharger 84 is connected to the circulation pipe 66. Also, the water discharger 84 is disposed proximally to the water discharge port 50*b* of the pillow part 50. Thereby, the water discharger 84 discharges, from the water discharge port 50*b* of the pillow part 50, the hot water supplied from the circulation pipe 66.

The pillow part 50 has a hollow dome configuration and covers and hides the supporters 80, the axial part 82, and the water discharger 84 in the state of being mounted to the axial part 82. The pillow part 50 moves with the axial part 82 in the vertical direction and the frontward/rearward direction over the prescribed range MA1 along the backrest part 30 in the state of covering the supporters 80, the axial part 82, and the water discharger 84.

For example, the pillow part 50 covers the supporters 80, the axial part 82, and the water discharger 84 in the frontward/rearward direction, the left/right direction, and the upward direction (a direction perpendicular to the backrest part 30). In other words, the pillow part 50 suppresses the undesirable visibility to the bather, etc., of the supporters 80, the axial part 82, and the water discharger 84. The beauty of the bathtub 10 can be improved thereby.

Figure 10:
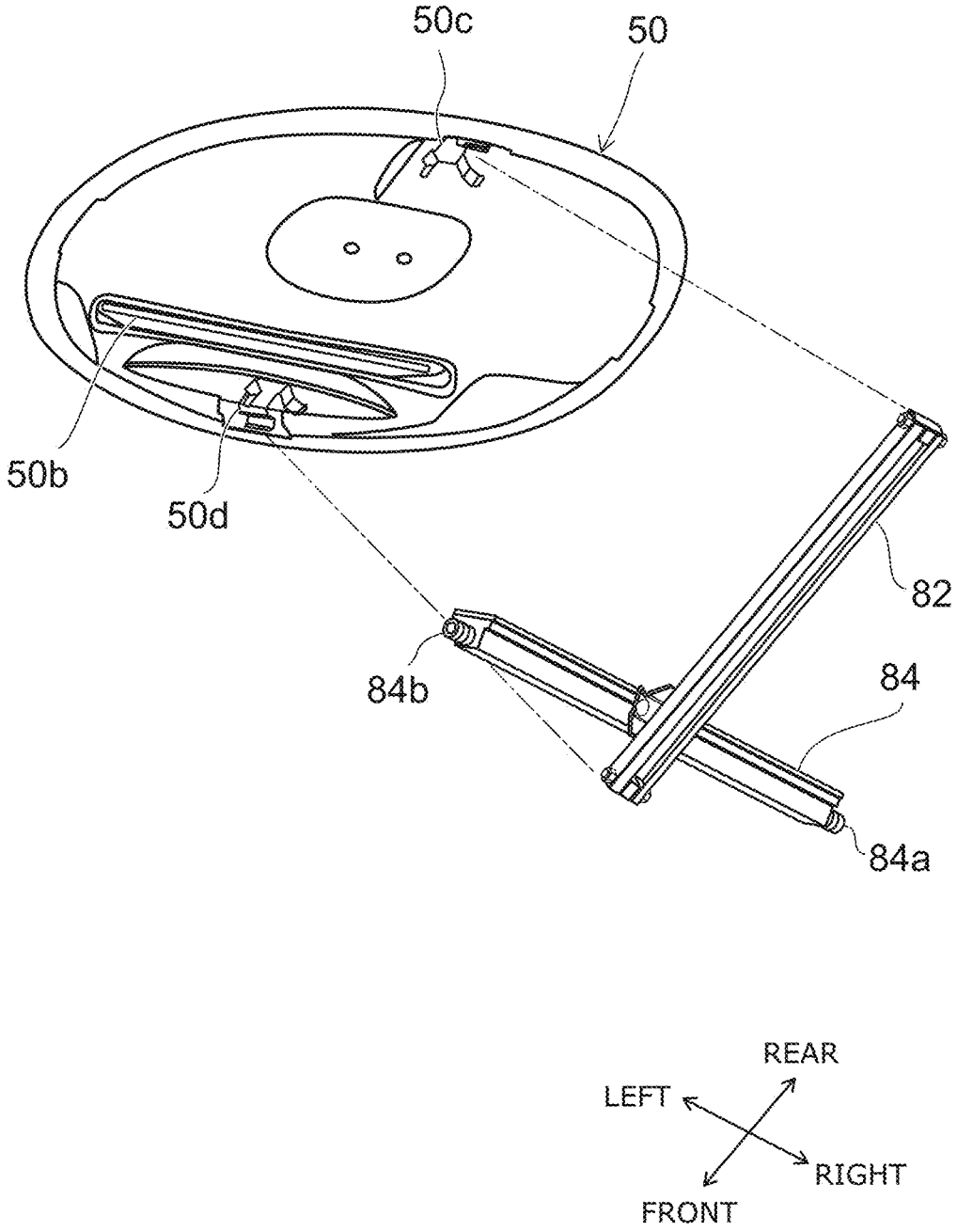
FIG. 10 is a perspective view schematically illustrating a part of the bathtub according to the embodiment.

FIG. 10 is a perspective view schematically illustrating a part of the bathtub according to the embodiment.

In FIG. 10, the state in which the pillow part 50, the axial part 82, and the water discharger 84 are viewed obliquely from below is schematically illustrated.

As illustrated in FIG. 10, a pair of mounting members 50*c* and 50*d* for detachably mounting the pillow part 50 to the axial part 82 is provided in the interior of the hollow pillow part 50.

The mounting members 50*c* and 50*d* are provided to be arranged in the vertical direction (the frontward/rearward direction). The mounting member 50*c* is provided at the upper-end side (the rear-end side) inside the pillow part 50. The mounting member 50*d* is provided at the lower-end side (the front-end side) inside the pillow part 50. The mounting members 50*c* and 50*d* are formed in clip configurations. By clamping the two side surfaces of the axial part 82, the mounting members 50*c* and 50*d* regulate the movement of the pillow part 50 in the left/right direction with respect to the axial part 82. Also, by clamping the lower end (the front end) and the upper end (the rear end) of the axial part 82 between the mounting member 50*c* and the mounting member 50*d*, the mounting members 50*c* and 50*d* regulate the movement of the pillow part 50 in the vertical direction (the frontward/rearward direction) with respect to the axial part 82. In other words, the axial part 82 is provided at the backside of the pillow part 50 and has a slender configuration extending in the vertical direction within the range between the upper end and the lower end of the pillow part.

Thus, by clamping the axial part 82 with the mounting members 50*c* and 50*d*, the movement of the pillow part 50 toward the front, rear, left, and right with respect to the axial part 82 is regulated; and the pillow part 50 is mounted to the axial part 82. The method for mounting the pillow part 50 to the axial part 82 is not limited to that recited above; and any mounting method in which detachable mounting to the axial part 82 is possible may be used.

The water discharger 84 has a laterally-long configuration extending in the left/right direction. The length in the left/right direction of the water discharger 84 corresponds to the length in the left/right direction of the water discharge port 50*b* of the pillow part 50. The water discharger 84 discharges a broad band-shaped water stream extending in the left/right direction via the water discharge port 50*b*.

Figures 11A, 11B:
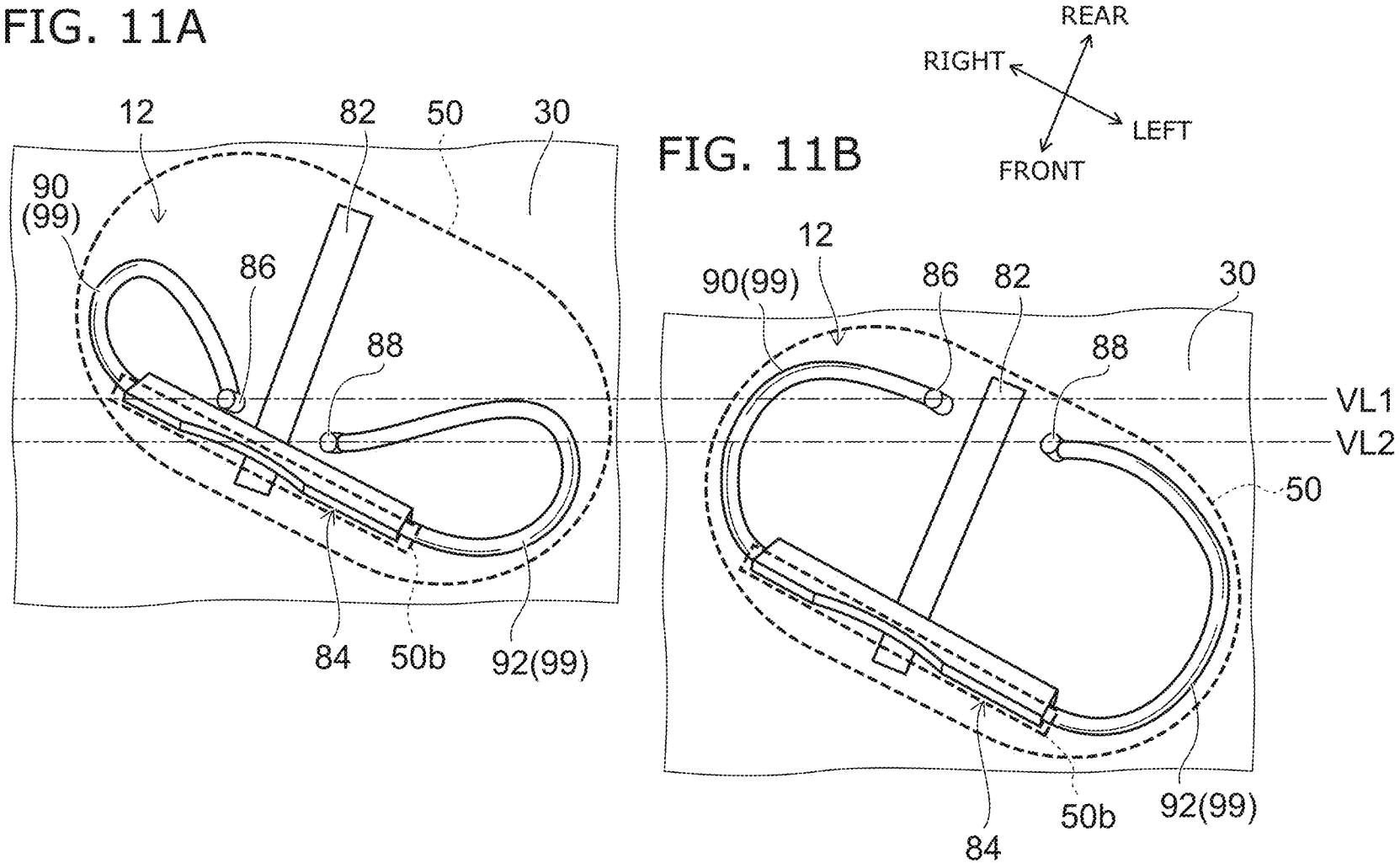
FIG. 11A and FIG. 11B are perspective views schematically illustrating a part of the bathtub according to the embodiment.

FIG. 11A and FIG. 11B are perspective views schematically illustrating a part of the bathtub according to the embodiment.

In FIG. 11A and FIG. 11B, the state in which the pillow part 50 is detached from the axial part 82 is illustrated. Also, FIG. 11A illustrates the state in which the axial part 82 is set to the highest position; and FIG. 11B illustrates the state in which the axial part 82 is set to the lowest position.

As illustrated in FIG. 11A and FIG. 11B, the bathtub 10 further includes a water supply functional part 99 and a pair of water suppliers 86 and 88. The water suppliers 86 and 88 are provided in the backrest part 30. The water suppliers 86 and 88 are disposed to be arranged in the left/right direction with the axial part 82 interposed. Over the entire range of the movement range of the pillow part 50, the water suppliers 86 and 88 are provided at positions that are covered with the pillow part 50.

The water suppliers 86 and 88 are provided to pierce the bathtub main body 12 and are connected to the circulation pipe 66 at the backside of the bathtub main body 12 (referring to FIG. 7 and FIG. 9). Accordingly, as illustrated by an imaginary line VL1 in FIG. 11A and FIG. 11B, the position of the water supplier 86 does not change even when the water discharger 84 is moved vertically. Similarly, as illustrated by an imaginary line VL2, the position of the water supplier 88 does not change even when the water discharger 84 is moved vertically. The circulation pipe 66 is divided into two branches partway through and is connected to the water suppliers 86 and 88. The circulation pipe 66 supplies, to the water suppliers 86 and 88, the hot water supplied from the pump 62.

In the example, a pair of supply pipes 90 and 92 is provided as the water supply functional part 99. The water supply functional part 99 (the supply pipes 90 and 92) connects the water discharger 84 and the water suppliers 86 and 88 and supplies, to the water discharger 84, the hot water supplied from the water suppliers 86 and 88. At least a part of the water supply functional part 99 is movable along the backrest part 30 according to the movement of the water discharger 84 when the water discharger 84 moves along the backrest part 30. For example, the supply pipes 90 and 92 have flexibility in which the shapes change according to the movement of the water discharger 84. Thereby, the hot water can be supplied appropriately to the water discharger 84 even when the water discharger 84 is movable vertically. The supply pipes 90 and 92 include, for example, rubber tubes, flexible hoses made of metal, etc.

The water supply functional part 99 (the supply pipes 90 and 92) can supply the hot water to the water discharger 84 stopped at any position within the prescribed range MA3. Further, the water supply functional part 99 (the supply pipes 90 and 92) can supply the hot water supplied from the water suppliers 86 and 88 also to the water discharger 84 moving vertically along the backrest part 30 with the pillow part 50. Thereby, the bather can move the pillow part 50 and the water discharger 84 while causing the water discharger 84 to discharge the hot water.

The water discharger 84 has a laterally-long configuration extending in the left/right direction and includes connectors 84*a* and 84*b* between the supply pipes 90 and 92 at the two ends in the left/right direction. The connector 84*a* extends in the right direction from one end of the water discharger 84. The connector 84*b* extends in the left direction from the other end of the water discharger 84. Thus, the connectors 84*a* and 84*b* extend in the left/right directions from the two ends in the left/right direction of the water discharger 84.

The supply pipe 90 connects the water supplier 86 and the connector 84*a*. The supply pipe 92 connects the water supplier 88 and the connector 84*b*. Thereby, the hot water that is supplied from the circulation pipe 66 is supplied to the water discharger 84 via the water suppliers 86 and 88 and the supply pipes 90 and 92.

It is not always necessary to provide the connectors 84*a* and 84*b* at the two ends of the water discharger 84; and it is sufficient for the connectors 84*a* and 84*b* to be provided at least at one end in the left/right direction of the water discharger 84. In the case where the water discharger 84 includes only one connector, the water supplier and the supply pipe also may be one each.

The pillow part 50 is provided at the front side of the backrest part 30 and covers the supply pipes 90 and 92 so that a load from the front does not act on the supply pipes 90 and 92 when the water discharger 84 is at any height within the prescribed range MA3 (in other words, when the pillow part 50 is at any height within the prescribed range MA1). In other words, in the example, the pillow part 50 functions also as a cover that covers the supply pipes 90 and 92. Accordingly, in the example, the pillow part 50 which is the cover moves vertically following the movement of the water discharger 84. For example, when viewed from the front, the entire supply pipes 90 and 92 are concealed in the pillow part 50 and therefore are not visible.

Also, in the example, the supply pipes 90 and 92 are disposed in the space between the pillow part 50 and the backrest part 30; and the pillow part 50 is separated from the supply pipes 90 and 92. Thereby, even if the pillow part 50 is deformed slightly by a load from the front, the load does not act on the supply pipes 90 and 92. Or, the pillow part 50 may have a rigidity such that the pillow part 50 does not deform even when the bather applies a load from the front.

A cover that covers the supply pipes 90 and 92 may be provided separately from the pillow part 50. The cover may not always function as a pillow supporting the head of the bather. Also, the cover may not always follow the movement of the water discharger 84. The cover may have any configuration such that the supply pipes 90 and 92 can be covered so that a load from the front does not act on the supply pipes 90 and 92 when the water discharger 84 is at any height within the prescribed range MA3.

Figure 12:
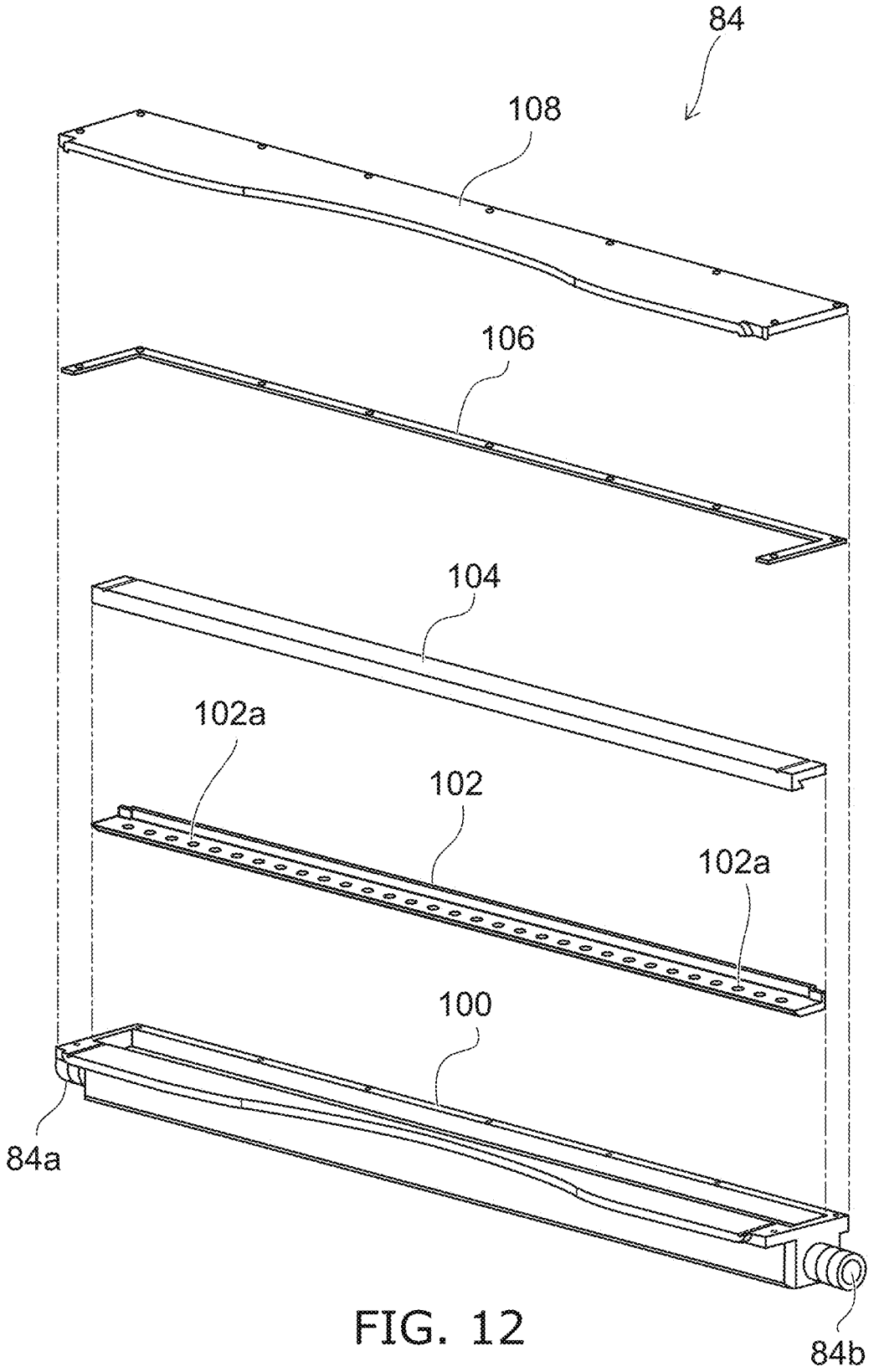
FIG. 12 is a perspective view schematically illustrating the water discharger of the bathtub according to the embodiment.

FIG. 12 is a perspective view schematically illustrating the water discharger of the bathtub according to the embodiment.

Figure 13:
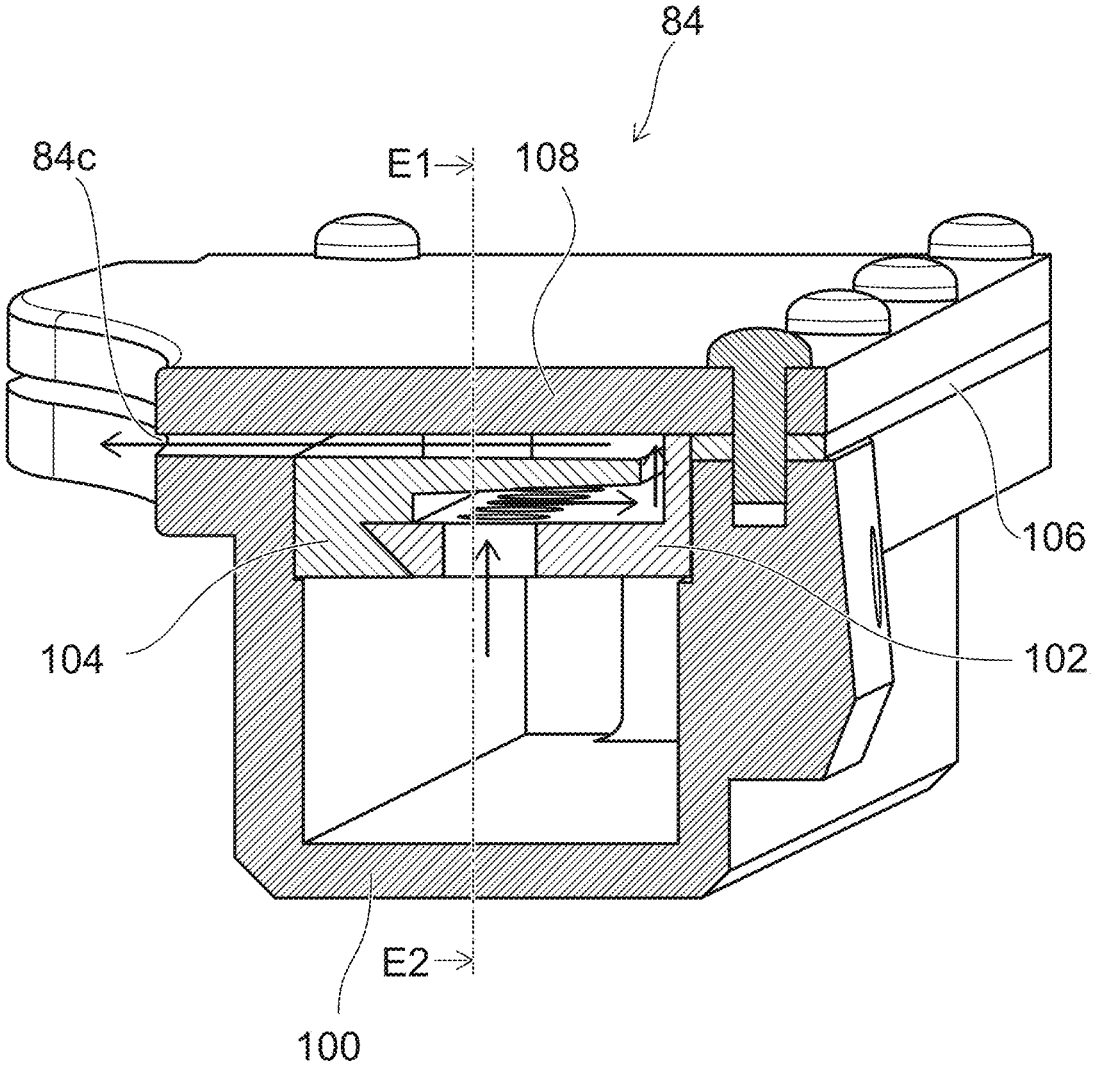
FIG. 13 is a cross-sectional view schematically illustrating the water discharger of the bathtub according to the embodiment.

FIG. 13 is a cross-sectional view schematically illustrating the water discharger of the bathtub according to the embodiment.

As illustrated in FIG. 12 and FIG. 13, the water discharger 84 includes a housing part 100, a baffle 102, a water flow path formation member 104, packing 106, and a lid part 108.

The housing part 100 has a substantially rectangular box configuration that is open upward. The connectors 84*a* and 84*b* are provided at two ends of the housing part 100. The hot water that is supplied from the connectors 84*a* and 84*b* accumulates inside the housing part 100.

The lid part 108 is mounted to the upper part of the housing part 100 and seals the opening at the upper part of the housing part 100. Also, the lid part 108 forms a gap upward and frontward of the housing part 100. Thereby, the housing part 100 and the lid part 108 form a water discharge port 84*c* having a slit configuration extending in the left/right direction frontward of the water discharger 84. The hot water that is supplied from the connectors 84*a* and 84*b* is discharged frontward from the water discharge port 84*c*.

The water discharge port 84*c* performs a broad water discharge extending in the left/right direction. Here, the "broad water discharge" is, for example, the water discharge mode in which the length in the left/right direction of the water stream discharged from the water discharge port 84*c* is longer than the length in the vertical direction of the water stream discharged from the water discharge port 84*c*. In other words, this is the water discharge mode in which the length in the left/right direction of the water discharge port 84*c* is longer than the length in the vertical direction of the water discharge port 84*c*. The length in the left/right direction of the water discharge port 84*c* is, for example, not less than 2 times the length in the vertical direction of the water discharge port 84*c*. The length in the left/right direction of the water discharge port 84*c* is, for example, about 20 cm-30 cm. The length in the left/right direction of the water discharge port 84*c* is, for example, longer than the average width of the neck of a human. Thereby, the hot water can be caused to appropriately contact the neck, the shoulders, etc., of the bather.

The packing 106 is provided between the housing part 100 and the lid part 108. The packing 106 is made from an elastic material such as rubber, etc., and suppresses the undesirable leakage of water between the housing part 100 and the lid part 108 in directions other than the water discharge port 84*c*.

By supplying the hot water from both the left and right sides to the housing part 100 which is long in the left/right direction, the undesirable occurrence of a bias in the left/right direction in the water discharged from the water discharge port 84*c* can be suppressed. For example, the undesirable occurrence of the bias in the left/right direction in the water overflowing upward from the housing part 100 can be suppressed. Accordingly, a beautiful band-shaped water stream can be discharged from the water discharge port 84*c*.

The baffle 102 has multiple openings 102*a* arranged in the left/right direction. The baffle 102 is provided at the upper part inside the housing part 100. By causing the hot water accumulating inside the housing part 100 to pass through the openings 102*a*, the baffle 102 straightens the flow of the water so that the water overflows uniformly from the housing part 100 in the left/right direction. The undesirable occurrence of the bias in the left/right direction in the water discharged from the water discharge port 84*c* can be suppressed further thereby.

The water flow path formation member 104 is provided between the baffle 102 and the lid part 108 inside the housing part 100. The water flow path formation member 104 obstructs the upward flow of the water passing through the openings 102*a* of the baffle 102. The water flow path formation member 104 forms a water flow path flowing to the water discharge port 84*c* by once directing the water passing through the openings 102*a* of the baffle 102 toward the rear and by directing the water toward the front by folding back at the end part of the water flow path formation member 104.

By forming a water flow path such as that recited above, compared to a configuration in which the water that passes through the openings 102*a* of the baffle 102 flows upward directly to the water discharge port 84*c*, the undesirable occurrence of the bias in the left/right direction in the water discharged from the water discharge port 84*c* can be suppressed further. The water stream that is discharged from the water discharge port 84*c* can have a more beautiful band configuration.

Figure 14A:
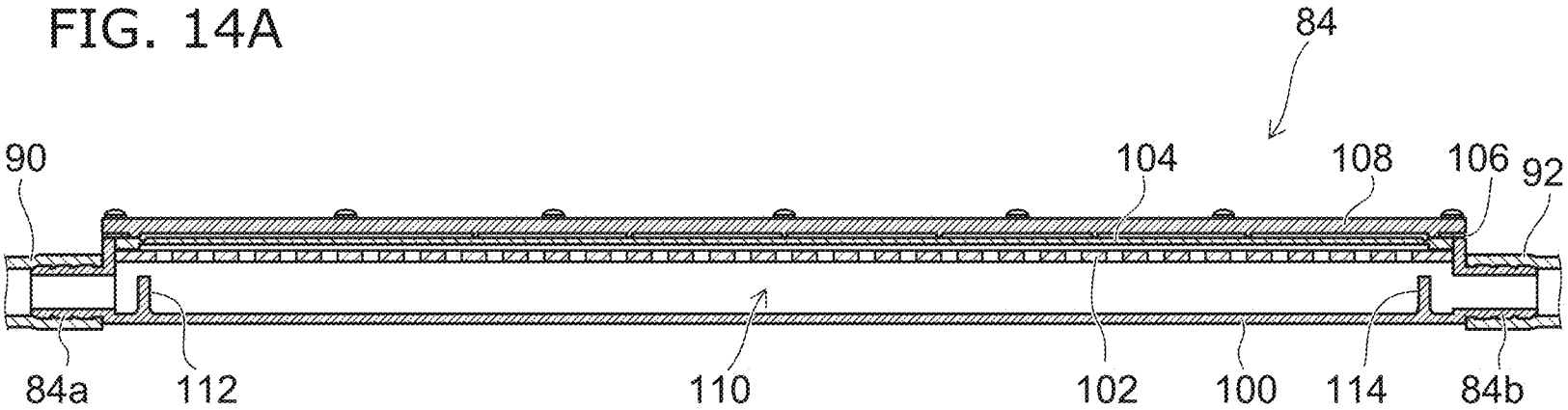
FIG. 14A and FIG. 14B are cross-sectional views schematically illustrating the water discharger of the bathtub according to the embodiment.
Figure 14B:
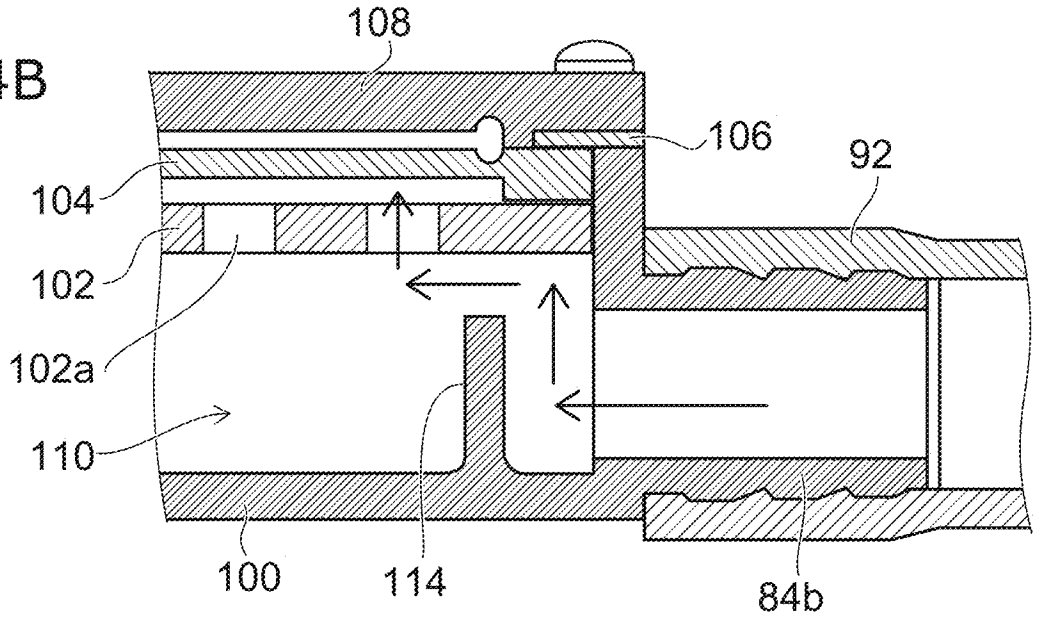

FIG. 14A and FIG. 14B are cross-sectional views schematically illustrating the water discharger of the bathtub according to the embodiment.

FIG. 14A and FIG. 14B correspond to a line E1-E2 cross section of FIG. 13. Also, FIG. 14B is an enlarged view of an enlarged part of FIG. 14A.

As illustrated in FIG. 14A and FIG. 14B, the housing part 100 of the water discharger 84 includes an internal flow channel 110 and a pair of decelerators 112 and 114.

The internal flow channel 110 feeds, to the water discharge port 84*c*, the hot water supplied from the pair of connectors 84*a* and 84*b* provided at the two ends. The internal flow channel 110 extends in the left/right direction and communicates with the connectors 84*a* and 84*b* respectively in the left/right direction.

The decelerators 112 and 114 are provided in the internal flow channel 110 to correspond respectively to the pair of connectors 84*a* and 84*b* and decelerate the force of the hot water inflowing from the pair of connectors 84*a* and 84*b*. The decelerator 114 is disposed proximally to the connector 84*b*. The distance between the decelerator 114 and the connector 84*b* is, for example, not less than 1 mm and not more than 10 mm. The decelerator 114 opposes the connector 84*b* in the left/right direction. The decelerator 114 is, for example, a member having a plate configuration opposing the connector 84*b*. The member that has the plate configuration extends in a direction (e.g., the vertical direction or the frontward/rearward direction) crossing the left/right direction and overlaps the connector 84*b* in the left/right direction. A part of the connector 84*b* may not oppose the decelerator 114. However, it is favorable for the decelerator 114 to oppose a part that is not less than 90% of the connector 84*b* in the left/right direction.

The hot water that flows into the internal flow channel 110 from the connector 84*b* contacts the decelerator 114, is directed once in a direction (e.g., the upward direction) orthogonal to the left/right direction, and flows again in the left/right direction from the periphery of the decelerator 114. The force of the hot water inflowing from the connector 84*b* can be decelerated thereby.

The decelerator 112 is disposed proximally to the connector 84*a*. The configuration of the decelerator 112 is substantially the same as the configuration of the decelerator 114; and a detailed description is therefore omitted.

Figure 15:
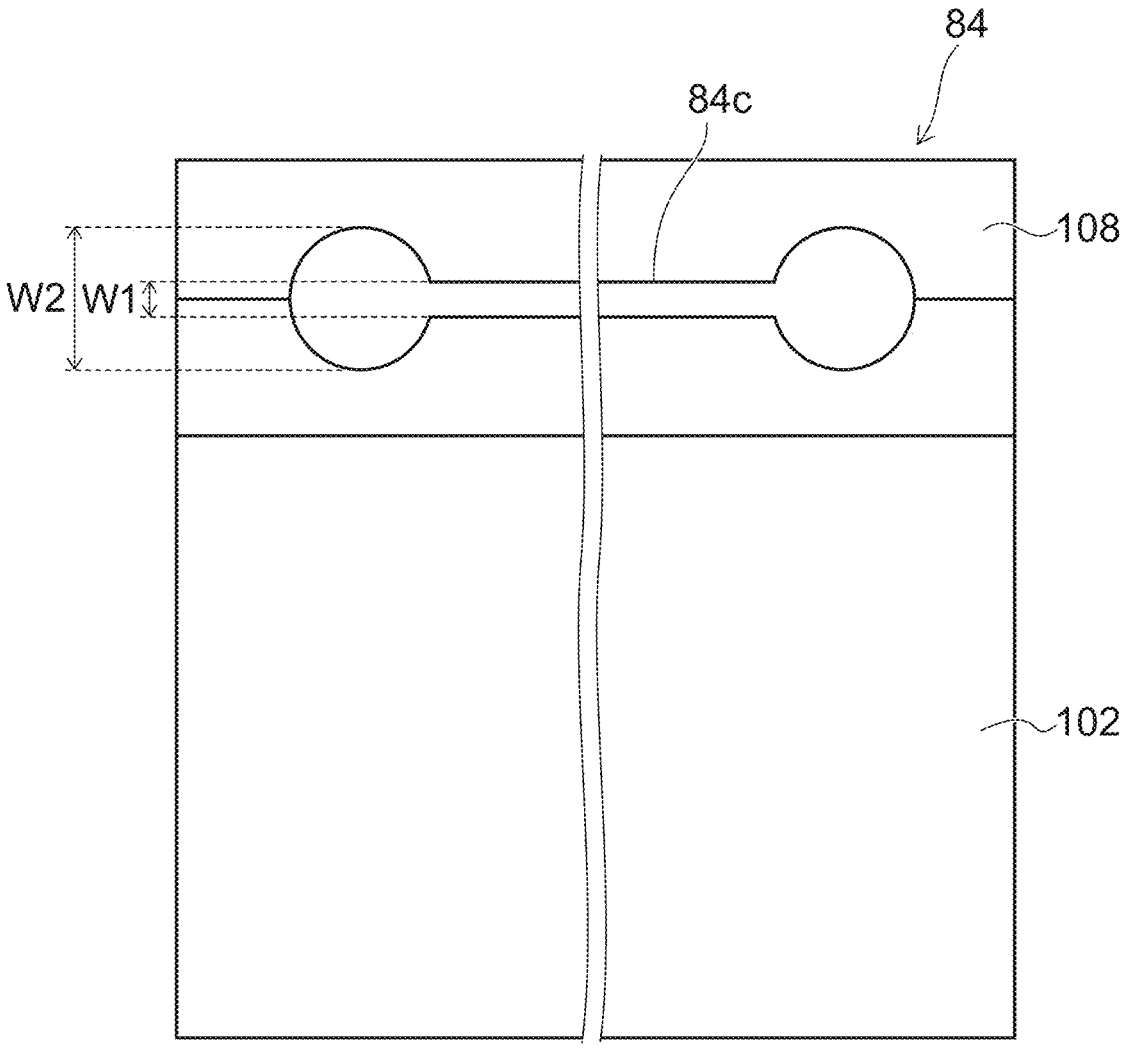
FIG. 15 is a front view schematically illustrating the water discharger of the bathtub according to the embodiment.

FIG. 15 is a front view schematically illustrating the water discharger of the bathtub according to the embodiment.

As illustrated in FIG. 15, a width W2 in the vertical direction of the two end parts of the water discharge port 84*c* is wider than a width W1 in the vertical direction of the central part of the water discharge port 84*c*. Thereby, the water discharger 84 causes the flow rate of the hot water discharged from the two end parts of the water discharge port 84*c* to be more than the flow rate of the hot water discharged from the central part of the water discharge port 84*c*. Thereby, the undesirable concentration of the band-shaped water stream discharged from the water discharge port 84*c* at the center as the band-shaped water stream flows downward can be suppressed. Accordingly, the water stream that is discharged from the water discharge port 84*c* can have a more beautiful band configuration.

Figure 16:
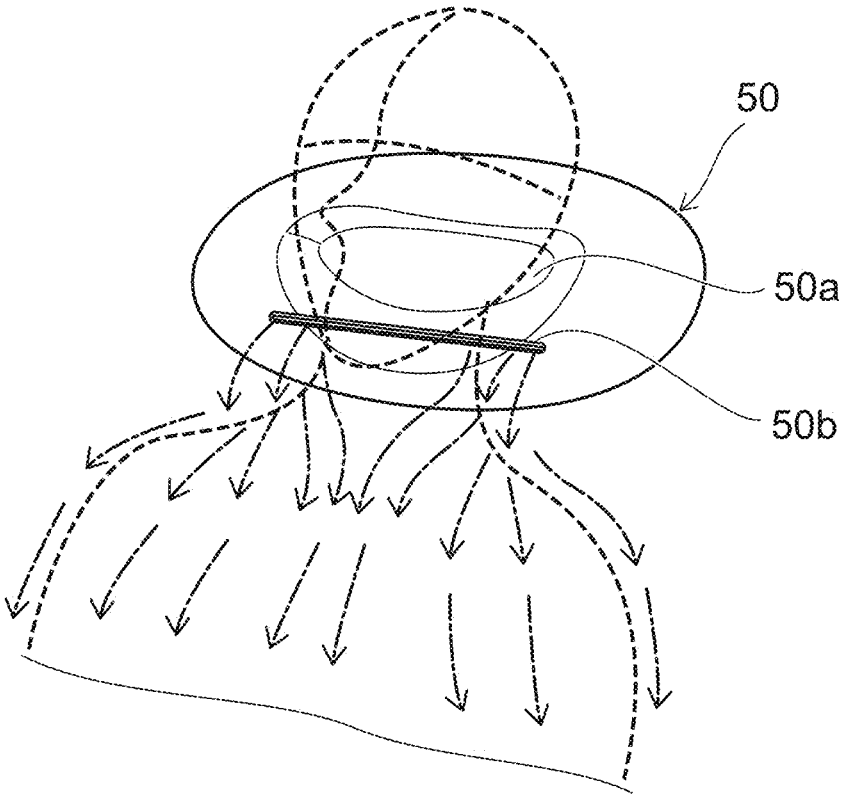
FIG. 16 is a perspective view schematically illustrating an example of the state of use of the bathtub according to the embodiment.

FIG. 16 is a perspective view schematically illustrating an example of the state of use of the bathtub according to the embodiment.

As illustrated in FIG. 16, the band-shaped hot water of the water discharger 84 discharged via the water discharge port 50*b* of the pillow part 50 contacts the neck part of the bather. Also, a part of the band-shaped hot water discharged from the water discharger 84 flows onto the chest of the bather via the neck part of the bather and flows also onto the shoulders of the bather via the body of the bather and the backrest part 30.

Thereby, for example, the upper body of the bather can be warmed appropriately even when a bather having a tall body height sets the pillow part 50 to the highest position and performs reclined bathing and the shoulders, the chest, etc., undesirably jut higher than the water surface, etc.

FIG. 17A to FIG. 17L are descriptive views schematically illustrating an example of a bath exit procedure of the bathtub according to the embodiment.

FIG. 17A to FIG. 17L are substantially the same as the state illustrated in FIG. 4. Accordingly, a detailed description of the reference numerals is omitted for convenience in FIG. 17A to FIG. 17L.

As illustrated in FIG. 17A, when exiting the bath from the state of performing reclined bathing by causing the back to contact the backrest part 30, causing the supporter 44 to support the buttocks, and placing the legs on the second bottom surface 42, first, as illustrated in FIG. 17B, both hands are caused to contact the right-side handrest part 33 and the left-side handrest part 34.

Then, as illustrated in FIG. 17C to FIG. 17E, the upper body is raised while pressing the right-side handrest part 33 and the left-side handrest part 34 with both hands. At this time, in the bathtub 10, by both elbows being contained in the right-side trench part 35 and the left-side trench part 36, the hands can press the right-side handrest part 33 and the left-side handrest part 34 in a state in which the elbows are bent toward the backside while suppressing the opening of both armpits; and the bather can raise the upper body easily by the force due to this pressing.

Then, as illustrated in FIG. 17F, the buttocks are moved by sliding rearward from the supporter 44 toward the backrest part 30 along the horizontal first bottom surface 41. Then, as illustrated in FIG. 17G, one leg or both legs are placed on the supporter 44. Then, as illustrated in FIG. 17H, the buttocks are moved by sliding further rearward by applying force to the leg placed on the supporter 44 and both hands contacting the right-side handrest part 33 and the left-side handrest part 34; and the buttocks are placed on the lower part (the first region R1) of the backrest part 30.

Then, as illustrated in FIG. 17I and FIG. 17J, both legs are placed on the horizontal first bottom surface 41 one leg at a time. In other words, a squatting posture is formed on the first bottom surface 41. Then, as illustrated in FIG. 17K and FIG. 17L, exiting the bath from the bathtub 10 is performed by applying force to both legs and by standing up on the first bottom surface 41.

Also, when entering and exiting the bathtub 10, the legs can be placed on the second bottom surface 42 that is horizontal and higher than the first bottom surface 41. Thereby, the bathtub main body 12 can be straddled easily; and entering and exiting the bath of the bathtub 10 can be easy.

Figure 18:
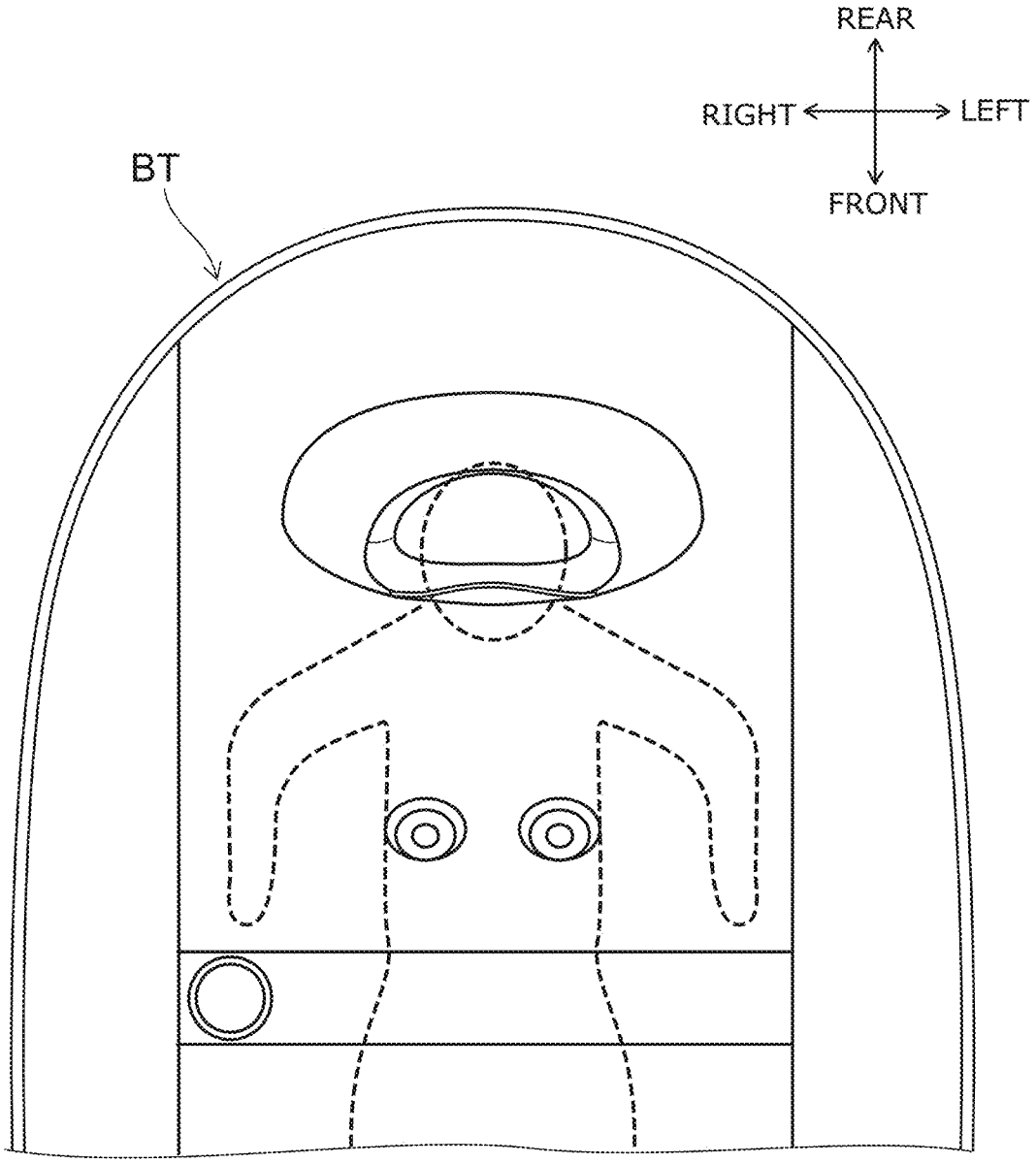
FIG. 18 is a plan view schematically illustrating a part of a reference bathtub.

FIG. 18 is a plan view schematically illustrating a part of a reference bathtub.

FIG. 18 illustrates a reference bathtub BT in which the right-side trench part 35, the left-side trench part 36, etc., are not provided in the backrest part; and the backrest part has a uniform inclined surface. In such a bathtub BT, when the upper body is raised from the reclined bathing state by pressing the hands to the backrest part, it is necessary for the armpits to open widely so that the elbows do not interfere with the backrest part as illustrated in FIG. 18. However, there are cases where it is difficult to raise the upper body because it is difficult to apply a large force to the hands when the armpits are opened widely.

For the structure of the musculoskeletal system of a human when providing a force by pressing using both hands, it is easy and therefore favorable to provide the force in the state in which both armpits are closed. Also, to realize the force of both arms to the utmost for the structure of the musculoskeletal system of a human, it is favorable to provide the force by pressing using both hands in the state in which the elbows are bent.

In the bathtub 10 according to the embodiment, by providing the right-side trench part 35 and the left-side trench part 36, the right-side handrest part and the left-side handrest part can be pressed by the hands in the state in which the elbows are bent toward the backside while suppressing the opening of both armpits as much as possible (referring to FIG. 3 and FIG. 17C). Then, the bather can raise the upper body easily by the force due to this pressing. Also, the upper body is raised by the hands of the bather pressing as-is on the right-side handrest part 33 and the left-side handrest part 34 which are where the hands would be disposed in the reclined bathing state. Accordingly, compared to the case where the upper body is raised by gripping the rim of the bathtub 10, the bather can raise the upper body with a smaller pressure for the force of pressing to get up by providing points of force at the right-side handrest part 33 and the left-side handrest part 34 which are positions proximal to the body of the bather.

Unlike a technique in which the upper body is raised by gripping the rim, etc., in the case of the technique of raising the upper body by pressing, with the hands, the right-side handrest part 33 and the left-side handrest part 34 inside the bathtub main body 12 where the hot water accumulates, when pressing the right-side handrest part 33 and the left-side handrest part 34 to raise the upper body, it may be necessary to apply wasted force to the arms because the hands have slipped or for balancing so that the hands do not slip.

Conversely, in the bathtub 10, for the frontward and obliquely upward force necessary for raising the upper body, the right-side handrest part 33 and the left-side handrest part 34 are inclined downward to be substantially perpendicular surfaces; therefore, when pressing the right-side handrest part 33 and the left-side handrest part 34 to raise the upper body, it is difficult to apply forces along the surfaces of the right-side handrest part 33 and the left-side handrest part 34; it is unnecessary to apply wasted force to the arms because the hands have slipped or for balancing so that the hands do not slip; and the bather can raise the upper body more easily.

Also, in the bathtub 10, the lower end of the right-side trench part 35 is inclined downward and toward the front; and the lower end of the left-side trench part 36 is inclined downward and toward the front. Thereby, when raising the upper body by pressing the right-side handrest part 33 and the left-side handrest part 34, it is possible also to press the right-side trench part 35 and the left-side trench part 36 according to the angle of the raising of the upper body; and the upper body can be easier to raise by the bather.

Also, in the bathtub 10, the inclination angle with respect to the horizontal direction of the lower part of the right-side trench part 35 and the lower part of the left-side trench part 36 is larger than the inclination angle with respect to the horizontal direction of the right-side handrest part 33 and the left-side handrest part 34. Thereby, the upper body can be even easier to raise by the bather by setting the inclination angle of the right-side trench part 35 and the left-side trench part 36 to be larger than the inclination angle of the right-side handrest part 33 and the left-side handrest part 34 so that the right-side trench part 35 and the left-side trench part 36 are surfaces substantially perpendicular to the direction in which the force is applied to match the angle of the raising of the upper body.

Also, in the bathtub 10, the right-side shoulder rest part 31 and the left-side shoulder rest part 32 protrude frontward of the backrest part 30 or are flush with the backrest part 30. Thereby, even in the case where the right-side trench part 35 and the left-side trench part 36 for containing the elbows are provided, the undesirable sinking of the shoulders of the bather in the reclined bathing state toward the backside from the backrest part 30 can be suppressed. Thereby, bathing can be performed comfortably in a state of being more relaxed.

In the embodiment recited above, the right-side shoulder rest part 31 and the left-side shoulder rest part 32 are provided at both the left and right sides of the backrest part 30. The shoulder rest part may be provided at only one of the left side or the right side of the backrest part 30. In the embodiment recited above, the right-side handrest part 33 and the left-side handrest part 34 are provided at both the left and right sides of the backrest part 30. The handrest part may be provided at only one of the left side or the right side of the backrest part 30. In the embodiment recited above, the right-side trench part 35 and the left-side trench part 36 are provided at both the left and right sides of the backrest part 30. The trench part may be provided at only one of the left side or the right side of the backrest part 30.

As described in reference to FIG. 17, when the bather stands up from the reclined bathing state, the buttocks that contact the supporter 44 are moved by sliding in the direction of the backrest part 30 on the horizontal first bottom surface 41 (referring to FIG. 17F). Subsequently, a leg is retracted; and the sole of the foot is placed on the supporter 44 (referring to FIG. 17G). Then, by applying the force to extend the leg from this state, the buttocks are placed on the backrest part 30 and raised along the incline of the backrest part 30 (referring to FIG. 17H).

In the bathtub 10, the inclination angle of the supporter 44 is set to be larger than the inclination angle of the backrest part 30 at the same height. Thereby, the undesirable rising of the sole of the foot along the incline of the supporter 44 before the buttocks rise along the incline of the backrest part 30 can be suppressed when applying the force to extend the knee from the state in which the sole of the foot is placed on the supporter 44. Thereby, the buttocks finally can be moved to a position higher than the lowermost end of the sole of the foot (e.g., the heel) (referring to FIG. 17I); and a posture in which it is easy to stand up can be formed inside the bathtub main body 12. Accordingly, the standing operation can be performed easily from the reclined bathing state while making reclined bathing possible in a state in which the legs are disposed at a position higher than the buttocks.

Also, in the bathtub 10, the lower end 30*a* of the backrest part 30 is linked to the first bottom surface 41. Also, from the position at the same height as the upper end 44*a* of the supporter 44 to the first bottom surface 41, the inclination angle of the backrest part 30 is smaller than the inclination angle of the supporter 44 at the same height. Thereby, the buttocks that contact the supporter 44 can be moved by sliding in the direction of the backrest part 30 on the horizontal first bottom surface 41; a leg can be retracted; and the buttocks can be raised as-is along the incline of the backrest part 30 from the first bottom surface 41 from the state in which the sole of the foot is placed on the supporter 44. Accordingly, the standing operation can be performed more easily.

By setting the inclination angle of the supporter 44 to be larger than the inclination angle of the backrest part 30 at the same height, the buttocks can be raised along the incline of the backrest part 30; on the other hand, because the backrest part 30 that is provided inside the bathtub main body 12 where the hot water accumulates is slippery, when a large force to extend the knee is applied from the state in which the sole of the foot is placed on the supporter 44, there is a risk that the buttocks may undesirably rise abruptly along the incline of the backrest part 30; and the knee may undesirably extend fully. If the sole of the foot undesirably slips when moving the sole of the foot to a section inside the bathtub where standing is easy in the state in which the knee is extended fully, it is difficult to again extend the leg to another section inside the bathtub main body 12 where standing is easy in order to prevent falling; and there is a possibility of undesirably falling.

In the bathtub 10, the backrest part 30 includes the flexure line FL provided at the boundary part between the first region R1 and the second region R2; and the inclination angle of the second region R2 is larger than the inclination angle of the first region R1. Thereby, the buttocks contact the flexure line FL when the buttocks rise along the incline of the backrest part 30. Thereby, a sudden rise of the buttocks can be stopped easily by the flexure line FL. In other words, the buttocks contact the flexure line FL; and it is easy to stop the rise of the buttocks at the position of a half-rising state in which the knee is not extended fully. Because the knee is not extended fully in the half-rising state, even if the sole of the foot undesirably slips, the operation of moving the sole of the foot to a section inside the bathtub main body 12 where standing is easy in order to prevent falling can be performed easily; and the standing operation can be performed more safely.

Also, in the bathtub 10, the flexure line FL is provided at a position that is higher than the upper end 44*a* of the supporter 44. Thereby, the position where the rise of the buttocks is stopped is a position that is higher than the upper end 44*a* of the supporter 44; therefore, the buttocks can be moved to a position higher than the entire sole of the foot; and a posture in which it is easier to perform the standing operation inside the bathtub main body 12 can be formed. Accordingly, the standing operation can be performed more easily and safely.

Also, in the bathtub 10, the bottom surface part 14 frontward of the supporter 44 is horizontal over its entirety. Thereby, the bather can stand on the horizontal bottom surface part 14 (the second bottom surface 42) frontward of the supporter 44 when straddling the bathtub main body 12 to enter the bathtub main body 12. Thereby, it can be easy to enter and exit the bathtub main body 12; and the bather falling when entering and exiting the bathtub main body 12 can be suppressed.

Also, in the bathtub 10, the abrupt incline part 38 is provided at the lower center of the backrest part 30. If the length in the frontward/rearward direction of the first bottom surface 41 is excessively short, the movement amount of the buttocks moving by sliding in the direction of the backrest part 30 becomes short; and it is undesirably difficult to place the sole of the foot on the supporter 44. On the other hand, if the supporter 44 undesirably is provided more distally frontward to lengthen the length in the frontward/rearward direction of the first bottom surface 41, it is difficult to cause the buttocks to contact the supporter 44 in the reclined bathing state; and it is undesirably difficult to perform reclined bathing in a state in which the buttocks contact the supporter 44. Conversely, in the bathtub 10, the abrupt incline part 38 that has an inclination angle with respect to the horizontal direction that is larger than that of the backrest part 30 is provided between the backrest part 30 and the first bottom surface 41. Therefore, because the lower part of the backrest part 30 which is a dead space that does not contribute very much to the reclined bathing state is shortened by the abrupt incline part 38, the distance of the first bottom surface 41 can be lengthened while suppressing the loss of the reclined bathing sensation. Accordingly, the operation of standing up can be easy while suppressing the loss of the reclined bathing sensation in reclined bathing in the state in which the buttocks contact the supporter 44.

Also, in the bathtub 10, the first bottom surface 41 is horizontal also in the left/right direction; and the length in the frontward/rearward direction of the two side parts of the first bottom surface 41 is longer than the length in the frontward/rearward direction of the central part of the first bottom surface 41. Thereby, a leg can be placed on the side part of the first bottom surface 41 when entering and exiting the bathtub main body 12; and it can be easier to enter and exit the bathtub main body 12. Therefore, the length in the frontward/rearward direction of the central part of the first bottom surface 41 is shorter than the length in the frontward/rearward direction of the two side parts; therefore, an undesirably long distance between the backrest part 30 and the supporter 44 can be suppressed. Accordingly, the operation of standing up can be easy while suppressing the loss of the reclined bathing sensation in reclined bathing in the state in which the buttocks contact the supporter 44.

Also, in the bathtub 10, the lower end of the overflow port 52 which is the regulating part regulating the overflow level of the water inside the space SP of the bathtub main body 12 is provided lower than the position H2 which is 120 mm higher than the position H1 of the head placement surface 50*a* in the state in which the pillow part 50 is disposed at the lowest position.

As a result of performing diligent investigations of the relationship between the posture of reclined bathing and the head structure of a human, the applicant obtained new knowledge in that the 5%-tile value of the length from the back of the head (the occipital point MBP) to the mouth is about 195 mm for an adult Asian female whose body height is relatively short globally speaking; and when considering the inclination of the reclined bathing and the state in which the chin is drawn inward, the length in the height direction from the head placement surface 50*a* to the mouth is about 120 mm or more. More specifically, the length from the occipital point MBP to the mouth is the length from the occipital point MBP to the mouth in a direction perpendicular to the coronal plane (the plane splitting the human body into the ventral side and the dorsal side). In other words, this is the length in the frontward/rearward direction (the horizontal direction) from the occipital point MBP to the mouth of a human in the state of standing erect and facing the front. Accordingly, by setting the overflow port 52 as recited above, even when a bather having a relatively small physique sets the height of the pillow part 50 to the lowest position and adds hot water into the bathtub main body 12, etc., the water level of the hot water inside the bathtub main body 12 exceeding the mouth of the bather can be suppressed; and undesirable discomfort of the bather can be suppressed.

To maintain the reclined bathing state, it is favorable for the buttocks of the bather to be supported by the supporter 44; however, the body of the bather undesirably generates buoyancy due to the hot water accumulated inside the bathtub main body 12 when under the water surface; therefore, it is not easy to firmly support the buttocks by the supporter 44. Also, if the body undesirably floats due to the buoyancy, there is a possibility that the bather cannot relax and cannot obtain a sufficient relaxation effect because the bather unconsciously applies force to muscles to balance the body.

Conversely, in the bathtub 10, by providing the first region R1 and the second region R2 in the backrest part 30, the back of the bather can be bent by the second region R2 having a larger inclination angle than the first region R1 while providing the bather with a reclined bathing sensation by the first region R1. Thereby, the bather can obtain a force pressing the body to the backrest part 30 and the supporter 44 of the bathtub main body 12 by utilizing the "spring force F of the back urging the back to straighten" that unconsciously acts on the bather in the state in which the back is bent. Also, because the pillow part 50 that is movable vertically is provided in the second region R2, the back of the bather can be bent in the reclined bathing state by the second region R2 even when the pillow part 50 is at the lowest position; and the bather can obtain a force pressing the body to the backrest part 30 and the supporter 44 of the bathtub main body 12. Therefore, by raising and lowering the pillow part 50, the bather can obtain a force pressing the body to the backrest part 30 and the supporter 44 of the bathtub main body 12 without applying a burden to the body while being able to perform reclined bathing with the position of the pillow part 50 matching one's own body height; and bathing is possible in a state of being relaxed.

Also, in the bathtub 10, because the flexure line FL is provided at the prescribed spacing DT below the lower end of the pillow part 50 at the lowest position, the back of the bather can be bent in the reclined bathing state more reliably by the second region R2 even when the pillow part 50 is at the lowest position; and the bather can obtain a force pressing the body to the backrest part 30 and the supporter 44 of the bathtub main body 12.

Also, the prescribed spacing DT is 100 mm or more. Thereby, the bather can obtain a force pressing the body to the backrest part 30 and the supporter 44 of the bathtub main body 12 more reliably without applying a burden to the body while being able to perform reclined bathing with the position of the pillow part 50 matching one's own body height; and bathing is possible in a state of being relaxed.

Also, as a result of performing diligent investigations of the relationship between the posture of reclined bathing and the heat retention effect of the body, the applicant obtained new knowledge in that when the shoulders, the chest, etc., jut higher than the water surface in the posture of reclined bathing, the heat retention effect when bathing and after bathing is higher by warming by causing hot water to contact the neck than by warming by causing hot water to contact the shoulders and/or the chest.

In the bathtub 10, the water discharger 84 that discharges water toward the neck part of the bather is provided; and the water discharger 84 follows the movement of the pillow part 50. Thereby, a chill felt by the upper body can be suppressed even when the shoulders, the chest, etc., of a bather having a tall body height jut higher than the water surface. Also, by warming the neck part, the chest, etc., of the bather by discharging the hot water from the water discharger 84, for example, the upper body of the bather can be warmed appropriately while suppressing the burden (the water pressure) on the heart of the bather compared to a bathing mode of being immersed to the neck.

In the bathtub 10, the pillow part 50 covers the supply pipes 90 and 92 so that a load from the front does not act on the supply pipes 90 and 92 when the water discharger 84 is at any height within the prescribed range MA3. Thereby, for example, the undesirable mashing and closing of the flexible supply pipes 90 and 92 due to a load from the front being applied to the supply pipes 90 and 92 by a part (the head, the back, an arm, etc.) of the body of the bather can be suppressed. Accordingly, the water discharge can be continued smoothly.

In the bathtub 10, the supporter 80 can be compact because the supporter 80 supports the axial part 82 to be movable in the vertical direction in only a partial range of the vertical direction and the frontward/rearward direction. Also, both the axial part 82 and the supporter 80 constantly are in a cover state when the pillow part 50 moves to any position in the vertical direction and the frontward/rearward direction. Thereby, the designability of the bathtub 10 can be improved further; the undesirable contact of the axial part 82, the supporter 80, etc., to the bather can be suppressed; and the relaxing effect can be improved further. Accordingly, the bathtub 10 can be provided in which the designability and/or the relaxing effect are improved further while the pillow part 50 is movable vertically and frontward/rearward.

In the bathtub 10, the supporter 80 slidably supports the axial part 82 by pressing the left and right inner side surfaces S1 and S2 or the left and right outer side surfaces S3 and S4 of the axial part 82 formed in planar configurations. Thus, because the axial part 82 is slidably supported, when performing a height adjustment to move the pillow part 50 in the vertical direction, a continuous adjustment is possible instead of a multi-level adjustment. Accordingly, the bather easily can finely adjust the height of the pillow part 50 to match the body height, etc.; therefore, the pillow part can be disposed at a height better matching the body height, etc.; and the higher relaxing effect can be improved further.

In the bathtub 10, the supporter 80 slidably supports the axial part 82 by pressing the left and right inner side surfaces S1 and S2 of the tubular part 82*a* with the contained part 80*b* (the left and right end parts E1 and E2 of the sliding member 80*e*). Thereby, the axial part 82 can be slidably supported by the supporter 80 using a simple structure. Also, because at least a part of the protruding part 80*a* is contained in the interior space of the axial part 82, the supporter 80 can be downsized further; and the axial part 82 and the supporter 80 can be covered more reliably with the pillow part 50.

In the bathtub 10, the lateral width of the opening 82*b* is narrower than the lateral width of the contained part 80*b*. Thereby, the tubular part 82*a* catches on the contained part 80*b* even when the bather unexpectedly applies a force to the pillow part 50 that would undesirably cause the tubular part 82*a* to detach from the contained part 80*b* when adjusting the height of the pillow part 50; therefore, it is difficult for the axial part 82 to be detached from the supporter 80; and the height adjustment of the pillow part 50 can be performed more easily.

In the bathtub 10, the supporter 80 is disposed higher than the overflow level OFL. The immersion of the supporter 80 in the hot water inside the bathtub main body 12 can be suppressed thereby. Thereby, dirt and/or degradation of the supporter 80 can be suppressed; and the axial part 82 can be slidably supported appropriately by the supporter 80 over a long period of time.

Figure 19A:
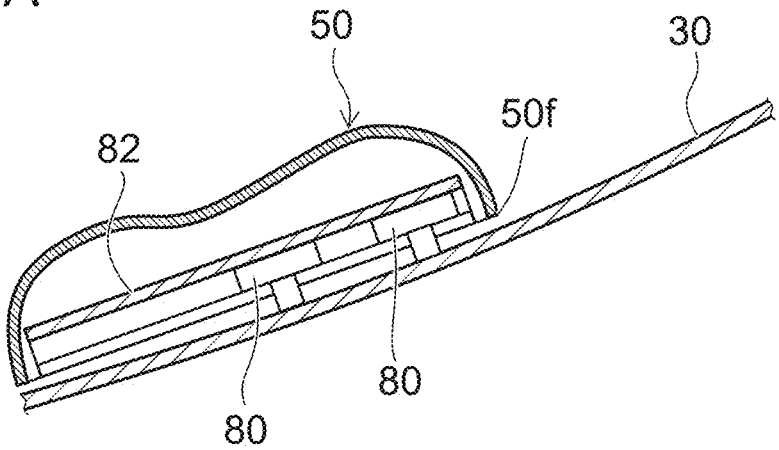
FIG. 19A to FIG. 19C are reference drawings schematically illustrating the movement of the axial part.
Figure 19B:
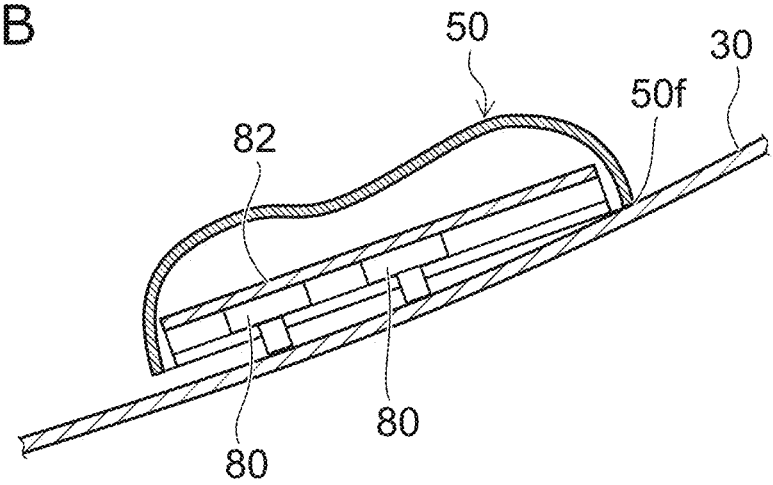
Figure 19C:
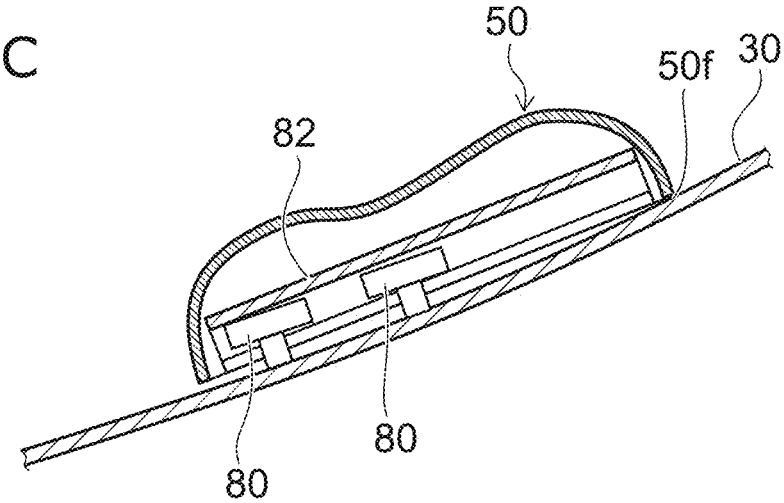

FIG. 19A to FIG. 19C are reference drawings schematically illustrating the movement of the axial part.

In FIG. 19A and FIG. 19B, the case is schematically illustrated where the length L11 of the contained part 80*b* in a direction perpendicular to the backrest part 30 is substantially the same as the length L12 of the interior of the tubular part 82*a* in the direction perpendicular to the backrest part 30. In such a case, the axial part 82 cannot move in the direction perpendicular to the backrest part 30.

For the axial part 82 that cannot move in the direction perpendicular to the backrest part 30, in the case where the backrest part 30 is curved in a concave configuration in the vertical direction while an outer perimeter part 50*f* of the pillow part 50 extends to the vicinity of the backrest part 30 to more reliably cover the axial part 82 and the supporter 80, the outer perimeter part 50*f* of the pillow part 50 and/or the axial part 82 contacts the backrest part 30 when the pillow part 50 is moved in the vertical direction and the frontward/rearward direction as illustrated in FIG. 19B; and there is a risk that the movement of the pillow part 50 may be obstructed and the backrest part 30 undesirably may be scratched.

Conversely, in the bathtub 10, the supporter 80 supports the axial part 82 to be movable in the vertical direction and the frontward/rearward direction and supports the axial part 82 to be movable also in the direction perpendicular to the backrest part 30. Thereby, as illustrated in FIG. 19C, even in the case where the backrest part 30 is curved in a concave configuration in the vertical direction while the outer perimeter part 50*f* of the pillow part 50 is extended to the vicinity of the backrest part 30 to more reliably cover the axial part 82 and the supporter 80, etc., the undesirable contact of the outer perimeter part 50*f* of the pillow part 50 and/or the axial part 82 to the backrest part 30 can be suppressed when moving the pillow part 50 in the vertical direction and the frontward/rearward direction. The undesirable obstructing of the movement of the pillow part 50 and scratching of the backrest part 30 due to the outer perimeter part 50*f* of the pillow part 50 and/or the axial part 82 contacting the backrest part 30, etc., can be suppressed while increasing the design degrees of freedom of the bathtub 10 by making a curved configuration of the backrest part 30 possible, etc.

In the bathtub 10, water discharge can be performed at a suitable position according to the physique such as the body height, etc., of the bather because the water discharger 84 is movable with the pillow part 50. Accordingly, a high relaxing effect can be provided to bathers of various physiques.

In the bathtub 10, it is easy to finely adjust the positions of the pillow part 50 and the water discharger 84 to a position corresponding to the physique of the bather because the pillow part 50 and the water discharger 84 can be moved while causing the water discharger 84 to discharge the hot water.

In the bathtub 10, because the supply pipes 90 and 92 have flexibility in which the shapes change according to the movement of the water discharger 84, water discharger 84 can be moved vertically; and water discharge can be performed at a position suited to the physique of the bather. Accordingly, a high relaxing effect can be provided to bathers of various physiques.

In the bathtub 10, the pillow part 50 covers the supply pipes 90 and 92 when the water discharger 84 is at any height within the prescribed range MA3. Thereby, for example, the undesirable mashing and closing of the supply pipes 90 and 92 due to a load from the front being undesirably applied to the supply pipes 90 and 92 by a part (the head, the back, an arm, etc.) of the body of the bather can be suppressed. Accordingly, the water discharge can be continued smoothly.

In the bathtub 10, the pillow part 50 moves vertically following the movement of the water discharger 84. Thereby, the pillow part 50 and the water discharger 84 can be disposed at a position suited to the physique of the bather because the height of the pillow part 50 also changes according to the height of the water discharger 84. Accordingly, even when bathers of different physiques bathe, the contact between the bather and the pillow part 50 such that the bather feels discomfort when discharging water from the water discharger 84 can be suppressed; and a higher relaxing effect can be provided to bathers of various physiques.

In the bathtub 10, the connectors 84*a* and 84*b* of the water discharger 84 extend in the left/right directions from one end in the left/right directions of the water discharger 84. The connectors 84*a* and 84*b* can be formed easily thereby. For example, the connectors 84*a* and 84*b* can be formed relatively easily even when the connectors 84*a* and 84*b* are formed as one body with the housing part 100 of the water discharger 84, etc. For example, the manufacturing cost of the water discharger 84 can be suppressed.

Figure 20A:
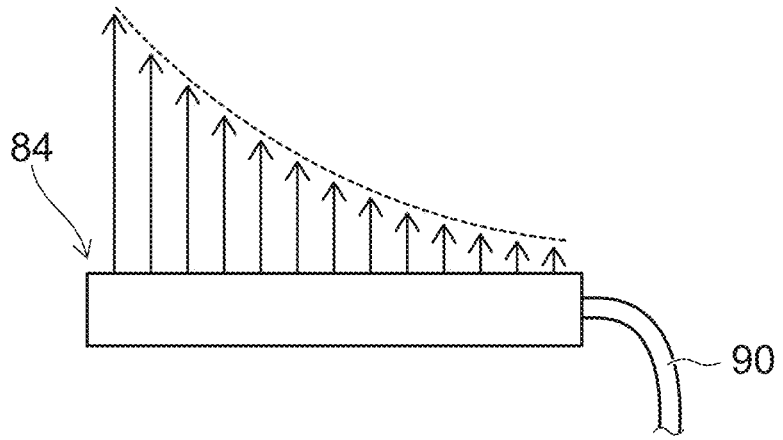
FIG. 20A to FIG. 20C are descriptive views schematically illustrating reference water dischargers.
Figure 20B:
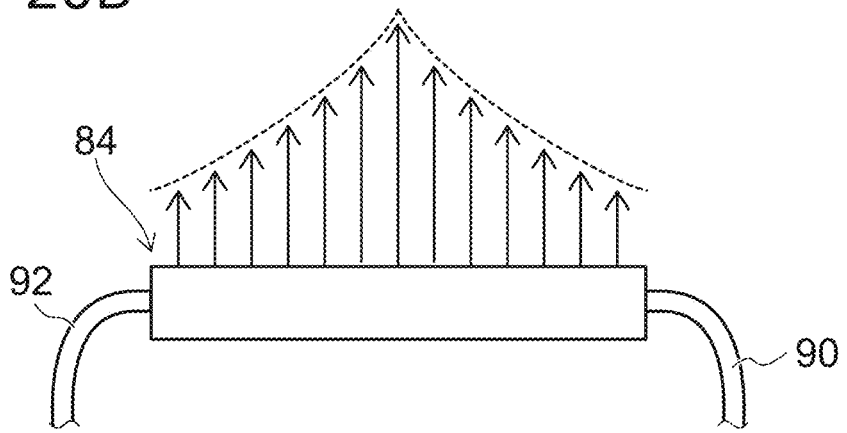
Figure 20C:
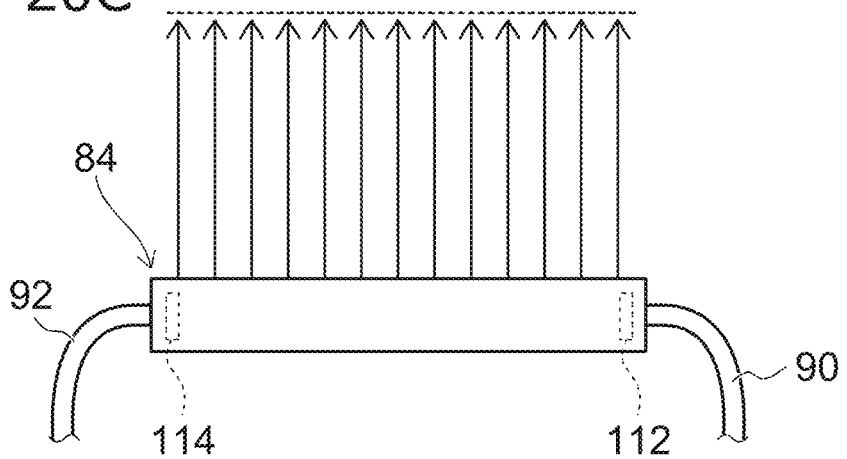

FIG. 20A to FIG. 20C are descriptive views schematically illustrating reference water dischargers.

As illustrated in FIG. 20A, when the hot water is supplied to the water discharger 84 having a laterally-long configuration only from one end in the left/right direction, the flow rate increases from the end part on the side opposite to the side where the hot water is supplied; and there are cases where a beautiful broad water discharge undesirably is not obtained.

Conversely, in the bathtub 10, the connectors 84*a* and 84*b* are provided at the two ends in the left/right direction of the water discharger 84; and the hot water is supplied to the water discharger 84 from the two ends in the left/right direction. Thereby, the fluctuation of the flow rate of the water discharge in the left/right direction can be suppressed; and a more beautiful broad water discharge can be performed.

Also, if the decelerators 112 and 114 are not provided when supplying the hot water to the water discharger 84 from the two ends in the left/right direction, there are cases where the flow rate undesirably increases at the central part in the left/right direction as illustrated in FIG. 20B.

Conversely, in the bathtub 10, the water discharger 84 includes the decelerators 112 and 114. Thereby, when supplying the hot water to the water discharger 84 from the two sides in the left/right direction, the undesirable increase of the flow rate at the central part in the left/right direction of the broad water discharge can be suppressed as illustrated in FIG. 20C. In other words, the fluctuation of the flow rate in the left/right direction can be suppressed further; and a broad water discharge that has a substantially uniform flow rate in the left/right direction is possible. Accordingly, a more beautiful broad water discharge can be performed.

Figure 21:
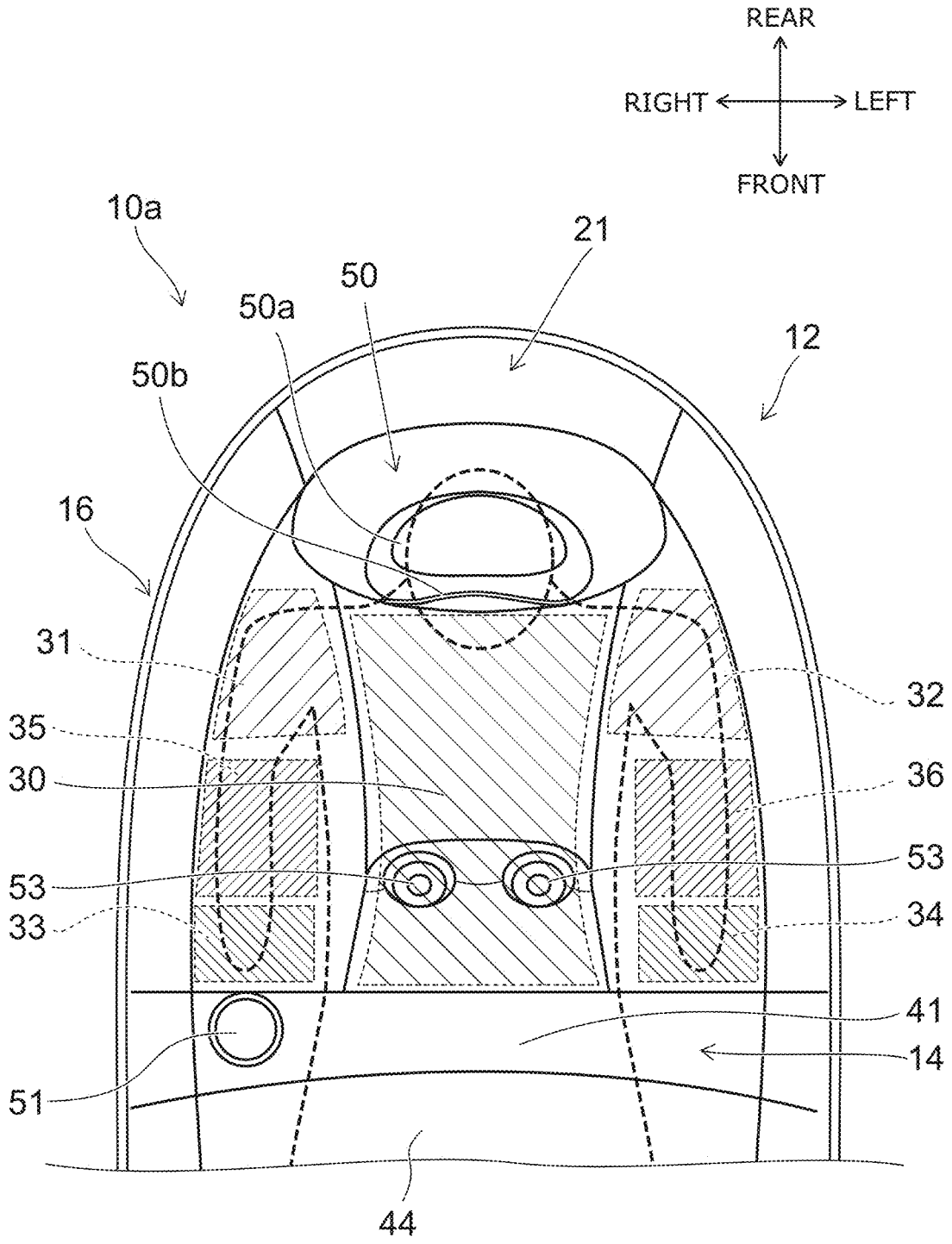
FIG. 21 is a plan view schematically illustrating a modification of the bathtub according to the embodiment.

FIG. 21 is a plan view schematically illustrating a modification of the bathtub according to the embodiment.

Components that are substantially the same functionally and configurationally as those of the embodiment recited above are marked with the same reference numerals; and a detailed description is omitted.

In the bathtub 10*a* as illustrated in FIG. 21, the right-side shoulder rest part 31 and the left-side shoulder rest part 32 are provided sideward of the backrest part 30 at both the left and right sides of the upper part of the backrest part 30. Also, in the bathtub 10 of the embodiment recited above, the right-side trench part 35 and the left-side trench part 36 are provided sideward of the backrest part 30 and respectively sideward of the right-side shoulder rest part 31 and the left-side shoulder rest part 32. Conversely, in the bathtub 10*a*, the right-side trench part 35 is provided between the right-side shoulder rest part 31 and the right-side handrest part 33 sideward of the backrest part 30; and the left-side trench part 36 is provided between the left-side shoulder rest part 32 and the left-side handrest part 34 sideward of the backrest part 30.

Thus, the right-side shoulder rest part 31 and the left-side shoulder rest part 32 may not always be formed as one body with the backrest part 30. For example, if the width in the left/right direction of the bathtub main body 12 is relatively narrow and the width of the backrest part 30 cannot be wide, etc., the right-side shoulder rest part 31 and the left-side shoulder rest part 32 may be provided sideward of the backrest part 30 as in the bathtub 10*a* illustrated in FIG. 21.

In the case where the right-side shoulder rest part 31 and the left-side shoulder rest part 32 are provided sideward of the backrest part 30 as well, it is favorable for the right-side shoulder rest part 31 and the left-side shoulder rest part 32 to protrude frontward of the backrest part 30 or to be flush with the backrest part 30. Thereby, as described above, the undesirable sinking of the shoulders of the bather in the reclined bathing state toward the backside from the backrest part 30 can be suppressed; and bathing can be performed comfortably in a state of being more relaxed.

Figure 22:
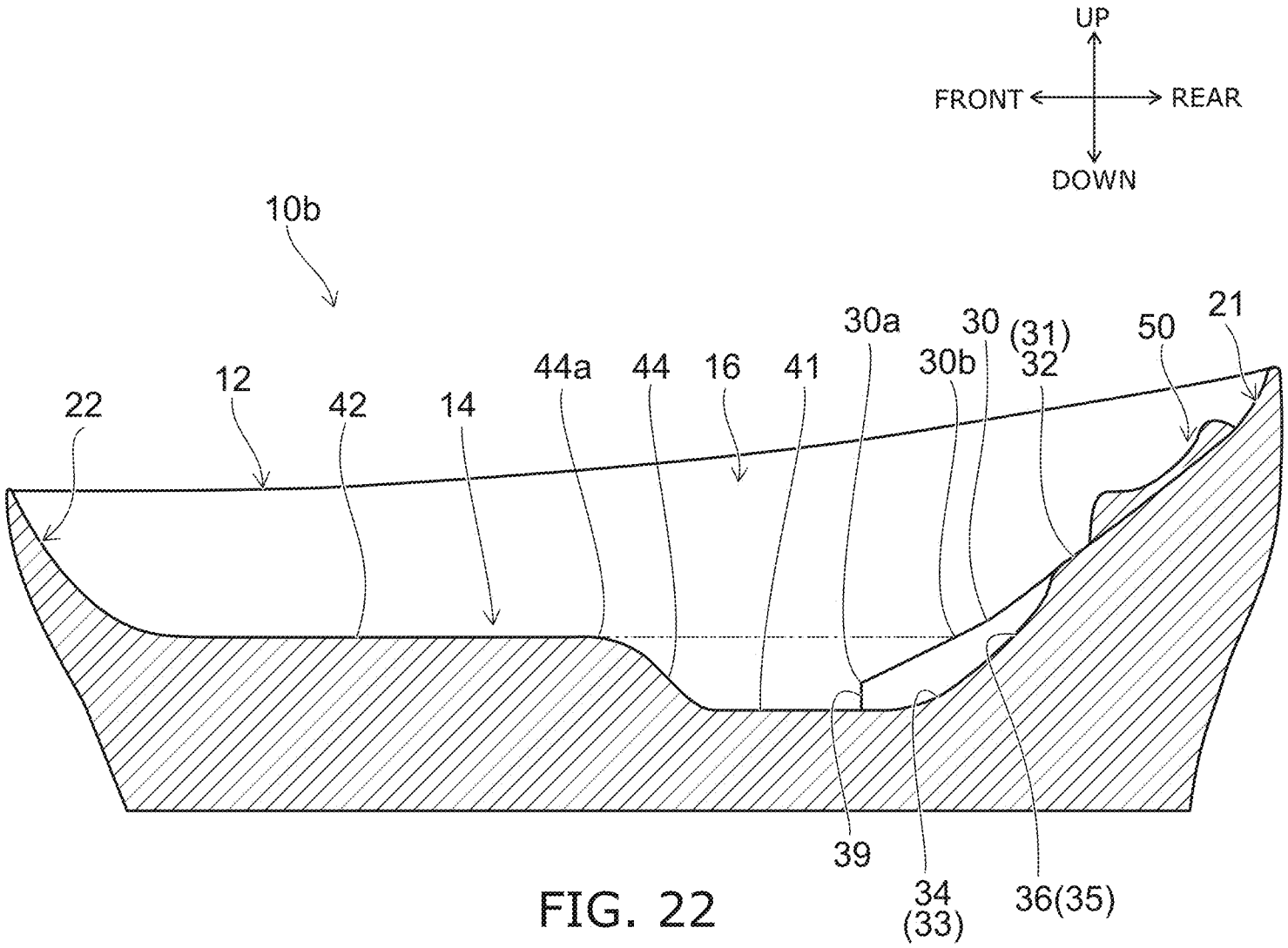
FIG. 22 is a cross-sectional view schematically illustrating a modification of the bathtub according to the embodiment.

FIG. 22 is a cross-sectional view schematically illustrating a modification of the bathtub according to the embodiment.

In a bathtub 10*b* as illustrated in FIG. 22, the backrest part 30 includes a step-like part 39. The step-like part 39 is provided at the lower part of the backrest part 30. Therefore, in the bathtub 10*b*, the lower end 30*a* of the part of the backrest part 30 having the continuous frontward and downward incline is positioned higher than the first bottom surface 41.

Thus, the lower end 30*a* of the backrest part 30 may not always be linked to the first bottom surface 41. The backrest part 30 may include a part that has a larger inclination angle than the supporter 44 at the same height.

However, it is favorable for the lower end 30*a* of the part of the backrest part 30 having the continuous frontward and downward incline to be positioned lower than the upper end 44*a* of the supporter 44. Thereby, as described above, the buttocks that contact the supporter 44 can be moved by sliding in the direction of the backrest part 30 on the horizontal first bottom surface 41; and the buttocks can be raised easily along the incline of the backrest part 30. The operation of standing up by the bather can be easy.

Figure 23:
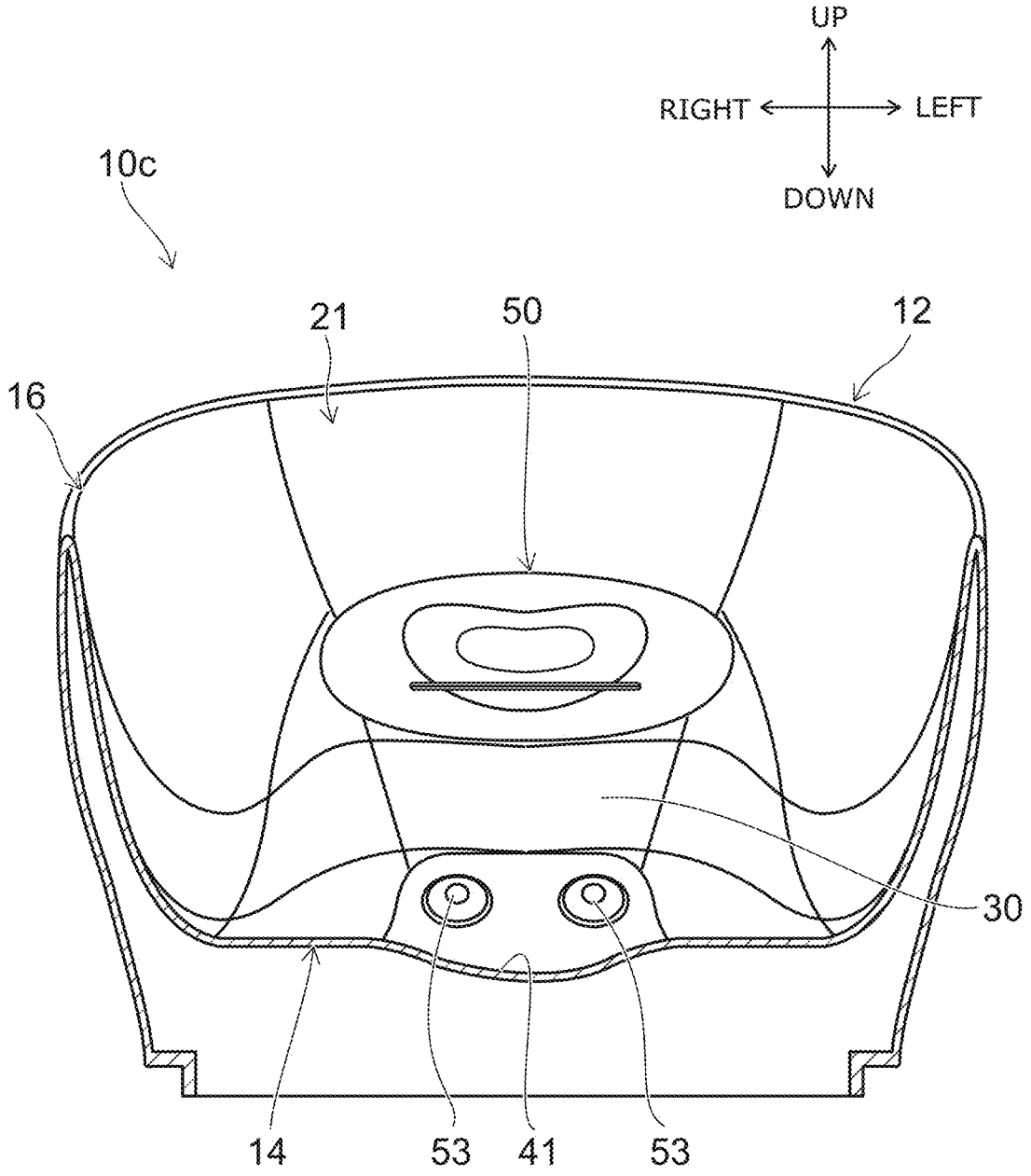
FIG. 23 is a cross-sectional view schematically illustrating a modification of the bathtub according to the embodiment.

FIG. 23 is a cross-sectional view schematically illustrating a modification of the bathtub according to the embodiment.

FIG. 23 schematically illustrates the state in which a part of the first bottom surface 41 of the bathtub main body 12 is cut by a cross section parallel to the left/right direction and the vertical direction and when viewed from the front side.

In the bathtub 10*c* as illustrated in FIG. 23, the first bottom surface 41 has a concave curved configuration in which the central part in the left/right direction is recessed lower than the two end parts in the left/right direction. Thus, it is sufficient for the first bottom surface 41 to be horizontal in at least the frontward/rearward direction; and the first bottom surface 41 may not always be horizontal in the left/right direction.

For example, the first bottom surface 41 has a concave curved configuration as illustrated in FIG. 23. In other words, the first bottom surface 41 has a curved configuration that easily fits to the buttocks of the bather. Thereby, for example, the curved surface in the left/right direction of the first bottom surface 41 can guide the buttocks of the bather appropriately to the backrest part 30 when the buttocks contacting the supporter 44 are moved by sliding in the direction of the backrest part 30 on the first bottom surface 41 that is horizontal in the frontward/rearward direction. For example, the buttocks of the bather undesirably sliding down to the right-side trench part 35, the left-side trench part 36, etc., can be suppressed. Accordingly, the operation of standing up by the bather can be easy.

On the other hand, as illustrated in FIG. 3, etc., if the first bottom surface 41 has a horizontal surface configuration, for example, it can be easy to stand on the first bottom surface 41 when exiting the bath, etc. For example, the falling of the bather, etc., can be suppressed more reliably; and the safety can be improved further. Also, the water that undesirably remains on the first bottom surface 41 when draining the water inside the bathtub main body 12, etc., can be suppressed; and the drainability also can be improved.

Figure 24B:
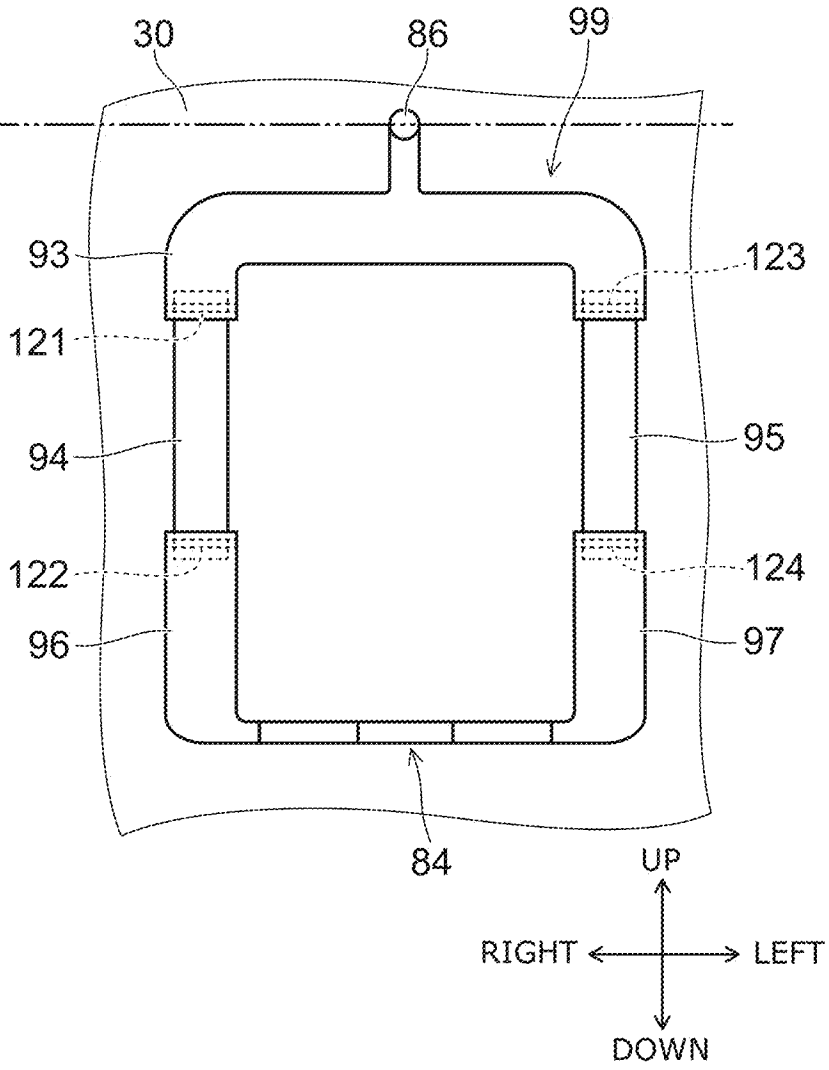
FIG. 24A and FIG. 24B are plan views schematically illustrating a modification of the water supply functional part of the bathtub according to the embodiment.
Figure 24A:
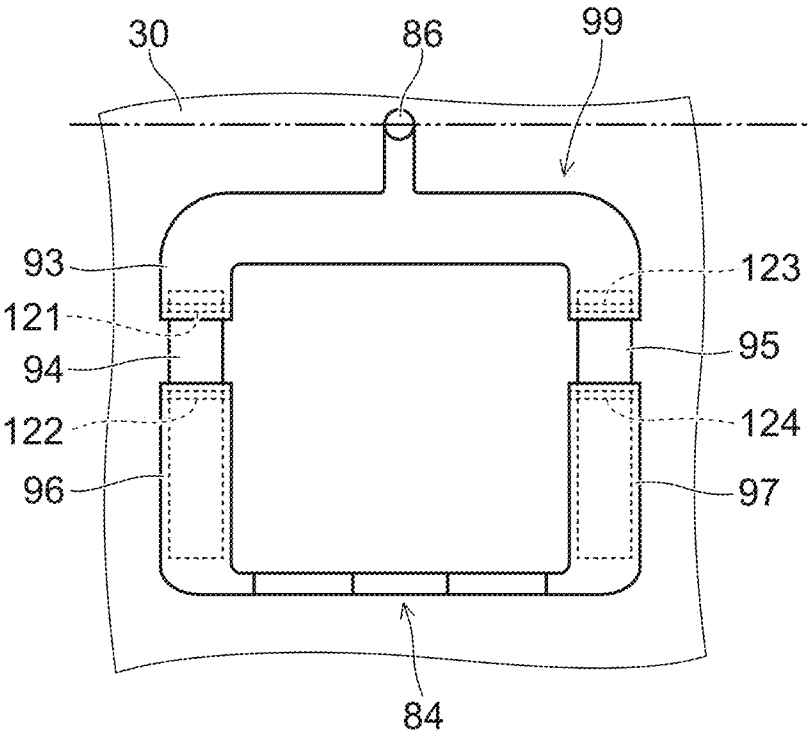

FIG. 24A and FIG. 24B are plan views schematically illustrating a modification of the water supply functional part 99 of the bathtub according to the embodiment.

FIG. 24A shows the state of the periphery of the water discharger 84 viewed from the front. Compared to the state of FIG. 24A, FIG. 24B shows a state in which the water discharger 84 is moved downward. Some components such as the pillow part 50, the supporter 80, the axial part 82, etc., are not illustrated.

The water supply functional part 99 connects the water supplier 86 and the water discharger 84 and supplies, to the water discharger 84, the hot water supplied from the water supplier 86. In the example, there is one water supplier. Also, supply pipes 93, 94, 95, 96, and 97 and packing 121, 122, 123, and 124 are provided as the water supply functional part 99. The supply pipes 93, 94, 95, 96, and 97 may not be flexible. The supply pipe 93 is connected to the water supplier 86 and is divided into two branches partway. The supply pipe 96 is connected to one end of the water discharger 84; and the supply pipe 97 is connected to the other end of the water discharger 84. The supply pipe 94 is inserted into the supply pipes 93 and 96 and links the supply pipe 93 and the supply pipe 96. The supply pipe 95 is inserted into the supply pipes 93 and 97 and links the supply pipe 93 and the supply pipe 97. The packing 121 to 124 are provided as appropriate at connection locations between the supply pipes. A part of the hot water supplied from the water supplier 86 is guided to the water discharger 84 from the right side by the supply pipes 93, 94, and 96. Another part of the hot water supplied from the water supplier 86 is guided to the water discharger 84 from the left side by the supply pipes 93, 95, and 97.

The supply pipes 96 and 97 move along the backrest part 30 according to the movement of the water discharger 84 when the water discharger 84 moves along the backrest part 30. Also, at least parts of the supply pipes 94, 95, 96, and 97 have pipe configurations extending parallel to the movement direction of the water discharger 84. Thereby, when the water discharger 84 moves upward, the supply pipe 94 is stored inside the supply pipe 96; and the supply pipe 95 is stored inside the supply pipe 97. When the water discharger 84 moves downward, the supply pipe 94 advances from the supply pipe 96; and the supply pipe 95 advances from the supply pipe 97. By such a configuration, the water discharger 84 can be moved vertically; and the water discharge can be performed at a position suited to the physique of the bather. Also, the water supply functional part 99 can supply the hot water supplied from the water supplier 86 also to the water discharger 84 moving vertically. In other words, the water discharger 84 can discharge water while moving. The configuration of the water supply functional part 99 is not limited to the example recited above. For example, the supply pipes 96 and 97 may be provided as one body with the water discharger 84; and the supply pipes 94 and 95 may be provided as one body with the supply pipe 93. The configuration of the water supply functional part 99 may be any configuration in which the hot water can be supplied to the movable water discharger 84.

Embodiments of the invention are described hereinabove. However, the invention is not limited to these descriptions. Appropriate design modifications made by one skilled in the art for the embodiments described above also are within the scope of the invention to the extent that the features of the invention are included. For example, the configuration, the dimensions, the material properties, the arrangement, etc., of each component included in the bathtub 10 etc., are not limited to those illustrated and can be modified appropriately.

Also, the components included in the embodiments described above can be combined within the limits of technical feasibility; and such combinations also are within the scope of the invention to the extent that the features of the invention are included.

INDUSTRIAL APPLICABILITY

According to aspects of the invention, a bathtub is provided in which a water discharger discharging water to the neck, the shoulders, etc., is included, and a high relaxing effect can be provided to bathers of various physiques.

REFERENCE NUMERAL LIST

10, 10*a* to 10*c* bathtubs
12 bathtub main body
14 bottom surface part
16 side surface part
21 first inner side surface
22 second inner side surface
30 backrest part
31 right-side shoulder rest part
32 left-side shoulder rest part
33 right-side handrest part
34 left-side handrest part
35 right-side trench part
36 left-side trench part
38 abrupt incline part
39 step-like part
41 first bottom surface (horizontal part)
42 second bottom surface (placement part)
44 supporter
50 pillow part
51 drainage port

52 overflow port (regulating part)
53, 54 injection ports
55 suction port
60 overflow pipe line
62 pump
64, 66 circulation pipes
68 drainage pipe
80 supporter
82 axial part
84 water discharger
86, 88 water suppliers
90, 92, 93, 94, 95, 96, 97 supply pipes
99 water supply functional part
100 housing part
102 baffle
104 water flow path formation member
106, 121, 122, 123, 124 packing
108 lid part
110 internal flow channel
112, 114 decelerators
FL flexure line
R1 first region
R2 second region

The invention claimed is:

1. A bathtub, comprising:
a bottom surface part;
a side surface part surrounding the bottom surface part, extending upward from the bottom surface part, and including a backrest part inclined downward and toward a front of the bathtub;
an axial part extending in the vertical direction along the backrest part;
a supporter supporting the axial part to be movable, the supporter being provided at the backrest part;
a pillow part being mounted to the axial part, the pillow part provided to be movable vertically over a prescribed range along the backrest part; and
a water discharger mounted to the pillow part, the water discharger being provided to be movable vertically along the backrest part with the pillow part, and
the pillow part being moved with the axial part over the prescribed range along the backrest part in the state of covering the supporter, the axial part, and the water discharger.

2. The bathtub according to claim 1, comprising:
a water supplier provided in the backrest part; and
a water supply functional part supplying, to the water discharger, hot water supplied from the water supplier,
the water supply functional part being capable of supplying the hot water supplied from the water supplier even when the water discharger is moving vertically along the backrest part with the pillow part.

3. The bathtub according to claim 1, comprising:
a water supplier provided in the backrest part; and
a supply pipe connecting the water discharger and the water supplier and supplying, to the water discharger, hot water supplied from the water supplier,
the supply pipe having flexibility in which a shape of the supply pipe changes according to movement of the water discharger.

4. The bathtub according to claim 3, wherein the pillow part covers the supply pipe so that a load from a front does not act on the supply pipe when the pillow part is at any height within the prescribed range.

5. The bathtub according to claim 3 or 4, wherein
the water discharger has a laterally-long configuration extending in a left/right direction, and includes a connector to the supply pipe at least at one end in the left/right direction, and
the connector extends in the left/right direction from the one end.

6. The bathtub according to claim 5, wherein
the water discharger has a water discharge port extending in the left/right direction and performing a broad water discharge, and
the connector is provided at two ends in the left/right direction.

7. The bathtub according to claim 6, wherein
the water discharger further includes:
an internal flow channel feeding, to the water discharge port, hot water supplied from a pair of the connectors provided at two ends of the internal flow channel; and
a pair of decelerators provided in the internal flow channel to correspond respectively to the pair of connectors, the pair of decelerators decelerating a force of the hot water flowing into the internal flow channel from the pair of connectors.

* * * * *